US011445823B2

(12) United States Patent
Bextermöller et al.

(10) Patent No.: US 11,445,823 B2
(45) Date of Patent: Sep. 20, 2022

(54) SLIDING-PIVOTING MECHANISM OF A SHELF OF A PIECE OF FURNITURE OR OF A HOUSEHOLD APPLIANCE, AND PIECE OF FURNITURE OR A HOUSEHOLD APPLIANCE

(71) Applicant: PAUL HETTICH GMBH & CO. KG, Kirchlengern (DE)

(72) Inventors: Benjamin Bextermöller, Melle (DE); David Krüger, Bad Oeynhausen (DE); Arnold Gurr, Osnabrück (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 17/055,363

(22) PCT Filed: May 6, 2019

(86) PCT No.: PCT/EP2019/061555

§ 371 (c)(1),
(2) Date: Nov. 13, 2020

(87) PCT Pub. No.: WO2019/219433

PCT Pub. Date: Nov. 21, 2019

(65) Prior Publication Data

US 2021/0212459 A1 Jul. 15, 2021

(30) Foreign Application Priority Data

May 15, 2018 (DE) ..... 10 2018 111 672.1
Dec. 19, 2018 (DE) ..... 10 2018 132 802.8

(51) Int. Cl.
*A47B 88/407* (2017.01)
*A47B 88/437* (2017.01)
(Continued)

(52) U.S. Cl.
CPC ..... *A47B 88/407* (2017.01); *A47B 88/437* (2017.01); *A47L 15/506* (2013.01);
(Continued)

(58) Field of Classification Search
CPC ..... A47B 88/48; A47B 88/407; A47B 88/437; A47B 2210/0037; A47L 15/50;
(Continued)

(56) References Cited

U.S. PATENT DOCUMENTS 5,115,822 A * 5/1992 Nichols ..... A47L 15/506 134/201
9,420,882 B2 8/2016 Garcia et al.
2006/0066189 A1* 3/2006 Bond ..... A47L 15/507 312/319.1

FOREIGN PATENT DOCUMENTS

DE 102012107993 A1 3/2014
DE 102014213986 A1 1/2016
(Continued)

OTHER PUBLICATIONS

International Search Report mailed on Jul. 23, 2019 in related/corresponding International Application No. PCT/EP2019/061555.
(Continued)

*Primary Examiner* — James O Hansen
(74) *Attorney, Agent, or Firm* — Patent Portfolio Builders PLLC

(57) ABSTRACT

A sliding-pivoting mechanism of a shelf of a piece of furniture or of a household appliance for extracting and raising the shelf out of a body of the piece of furniture or of the household appliance is provided. The mechanism includes at least two pivot arms of a pivoting mechanism, which are rotatably fixed by a first end to at least one of the side walls of the body, parallel to the plane of the side walls, and which are arranged parallel to and at a distance from
(Continued)

each other. At respective second ends of the pivot arms, a guide rail of a sliding mechanism is pivotably fixed parallel to the plane of the side walls such that the guide rail is pivotable from a lower position within the body into a raised, upper position at least partially outside the body, at least one running rail that is linearly displaceable in the guide rail and to which the shelf is fixed. The sliding-pivoting mechanism includes a lever unit supporting raising and lowering of the pivoting mechanism and is pivotably fixed to the running rail parallel to the plane of the side walls. A coupling element of a first coupling unit is arranged on the lever unit such that the coupling element is couplable to at least one of the pivot arms with a corresponding element of the first coupling unit, which corresponds to the coupling element, by displacing the running rail into a predetermined pivoting position.

14 Claims, 34 Drawing Sheets

(51) Int. Cl.
*A47L 15/50* (2006.01)
*F24C 15/16* (2006.01)
*F25D 25/02* (2006.01)

(52) U.S. Cl.
CPC ..... *A47L 15/507* (2013.01); *F24C 15/16* (2013.01); *F25D 25/025* (2013.01); *A47B 2210/0037* (2013.01); *A47B 2210/0056* (2013.01)

(58) Field of Classification Search
CPC ..... A47L 15/506; A47L 15/507; F24C 15/16; F25D 25/025
See application file for complete search history.

(56) References Cited

FOREIGN PATENT DOCUMENTS

| | | | |
|---|---|---|---|
| DE | 102014114285 | A1 | 4/2016 |
| DE | 102015102390 | A1 | 8/2016 |
| DE | 102015102500 | A1 | 8/2016 |
| DE | 102016201727 | A1 | 8/2017 |
| DE | 102017107541 | A1 | 10/2017 |
| DE | 102016121470 | A1 | 5/2018 |
| DE | 102016125040 | A1 | 6/2018 |
| WO | 2014033092 | A1 | 3/2014 |

OTHER PUBLICATIONS

Search Report created on Nov. 30, 2018 in related/corresponding DE Application No. 10 2018 111 672.1.
Search Report created on Sep. 23, 2019 in related/corresponding DE Application No. 10 2018 132 802.8.
Written Opinion mailed on Jul. 23, 2019 in related/corresponding International Application No. PCT/EP2019/061555.

* cited by examiner

SLIDING-PIVOTING MECHANISM OF A SHELF OF A PIECE OF FURNITURE OR OF A HOUSEHOLD APPLIANCE, AND PIECE OF FURNITURE OR A HOUSEHOLD APPLIANCE

BACKGROUND AND SUMMARY OF THE INVENTION

Exemplary embodiments of the present invention relate to a sliding-pivoting mechanism of a shelf of a piece of furniture or of a household appliance and also a piece of furniture or household appliance.

Such sliding-pivoting mechanisms are used, for example, in dishwashers for raising and lowering a bottom shelf, in particular of a dish rack, to enable the loading and unloading of the shelf in an upright position of a user, which relieves the back muscles and spinal column.

A generic sliding-pivoting mechanism is known, for example, from DE 10 2014 114 285 A1. The disclosed sliding-pivoting mechanism essentially has a pullout guide and a pivot mechanism having two pivot levers, which assist the raising or lowering of the shelf with the aid of a tension spring.

The actuation of the sliding-pivoting mechanism by the user is performed in this case by a lever unit, which assists the raising and lowering of the pivot mechanism. Simpler force-saving raising and lowering of the shelf is already enabled using this lever unit.

Exemplary embodiments of the present invention are directed to refining the sliding-pivoting mechanism in such a way that the actuating forces to be applied are reduced still further.

The sliding-pivoting mechanism according to the invention has at least two pivot arms of a pivot mechanism rotatably fixed on at least one of the side walls of the body having a first end parallel to the plane of the side walls and arranged spaced apart in parallel to one another.

On respective second ends of the pivot arms, a guide rail of a sliding mechanism is fixed pivotably in parallel to the plane of the side walls in such a way that the guide rail is pivotable from a lower position within the body into a raised upper position at least partially outside the body.

A slide rail is linearly displaceable in relation to the guide rail. The shelf is fastened on the slide rail.

The sliding-pivoting mechanism furthermore has a lever unit, which assists raising and lowering of the pivot mechanism and is pivotably fixed on the slide rail in parallel to the plane of the side walls.

At least one coupling element of a first coupling unit is arranged on the lever unit in such a way that the coupling element can be coupled to a correspondence element, which corresponds to the coupling element, of the first coupling unit of at least one of the pivot arms by sliding the slide rail into a predetermined pivot position.

Using such a lever unit integrated into the sliding-pivoting mechanism, simple coupling of the lever unit with at least one pivot lever is enabled by simply sliding forward the slide rail and the corresponding lever unit into the pivoting or raising position.

The required actuating forces for raising the shelf are also further reduced by this approach, since the first coupling unit permits an adaptation of the ratio of lift travel to actuating travel which is individual for the application.

According to one advantageous embodiment variant, at least one coupling element of a second coupling unit is arranged on the slide rail or the shelf in such a way that the coupling element can be coupled to a correspondence element, which corresponds to the coupling element, of the second coupling unit of at least one of the pivot arms by displacement of the slide rail into a predetermined pivot position.

This enables even more exact sequence control of the raising and lowering process.

According to a further advantageous embodiment variant, the coupling element of the first coupling unit is designed as a sliding or rolling element, preferably as a sliding pin or as a roller, which can be guided in a correspondence element, which is arranged, in particular formed, on the at least one of the pivot arms and is designed as a slotted guide, for the sequence control of the pivot movement of the lever unit.

The design of the components of the coupling unit as sliding or rolling element and slotted guide enables simple coupling of the respective components without complex coupling having to be used.

The coupling and also the decoupling can be carried out without an additional actuating element or a special unlocking movement and thus enable a fluid sequence of the coupling or decoupling.

The coupling element of the second coupling unit is designed according to a further embodiment variant as a sliding or rolling element, preferably as a sliding pin or as a roller, which can be guided in a correspondence element, which is arranged, in particular formed, on the at least one of the pivot arms and is designed as a slotted guide, for the sequence control of the pivot movement of the pivot mechanism. Alternatively, the slotted guide can also be formed in a separate element, which is arranged on one of the pivot arms.

According to one particular embodiment variant, the slotted guides of the first coupling unit and the second coupling unit are arranged, in particular formed, on the at least one of the pivot arms.

This enables one of the pivot arms to be designed relatively simply and only the other of the pivot arms to be formed having slotted guides.

According to an alternative embodiment variant, the slotted guide of the first coupling unit is arranged, in particular formed, on a first of the pivot arms and the slotted guide of the second coupling unit is arranged, in particular formed, on a second of the pivot arms.

According to a further embodiment variant, the coupling element of the first coupling unit is designed as a slotted guide, in which a correspondence element, which is arranged on at least one of the pivot arms and is designed as a roller, can be guided for the sequence control of the pivot movement of the lever unit.

The lever unit itself has, according to one preferred embodiment variant, at least one lever arm pivotably fixed using a first end on the slide rail in parallel to the plane of the side walls, on which the coupling element or the correspondence element of the first coupling unit is fastened.

At least one of the pivot arms, the pullout guide, the first coupling unit, and/or the lever unit are designed here such that a controlled sequence of the lever unit is ensured. In particular, raising the shelf too early and moving the lever unit too far beyond the end positions of the shelf are thus prevented.

At least one of the pivot arms, the pullout guide, the first coupling unit, and/or the lever unit advantageously has corresponding stop and/or guide regions.

In particular, corresponding guide regions are provided on the lever unit and on at least one of the pivot arms, which prevent the shelf from being pivoted up too early. Alternatively, instead of a guide region, a corresponding element can also interact with a guide region.

According to a further preferred embodiment variant, a joint chain is pivotably fastened on an end of the lever arm close to a lever arm mount of the lever arm, on the end of which remote from the lever arm the correspondence element of the first coupling unit designed as a roller is rotatably fastened.

With the aid of such a connecting link between actuating lever and slotted guide, a possibility is provided for decoupling position and course of actuating lever and slotted guide from one another. In the design of the formation of the slotted guide, first the course and the position of the actuating lever can be defined and subsequently a suitable position of the slotted guide can be determined. After defining the positions of slotted guide and actuating lever, due to the joint chain, sufficient degrees of freedom still remain in the kinematics of the sliding-pivoting mechanism for coupling the actuating lever with the slotted guide via the joint chain operating according to the toggle lever or drag lever principle.

In particular, due to the incorporation of the joint chain between lever arm and correspondence element of the coupling unit, the movement of the actuating lever may be designed in such a way that the handle fastened on one end of the lever arm is positioned in the raised state of the lower shelf so that a flatware shelf arranged above the upper shelf may still be pulled out when the lower shelf is raised.

The joint chain preferably has at least two chain links coupled to one another like a pivot joint for this purpose.

According to one refinement of this embodiment variant, the coupling element of the second coupling unit is designed as a sliding or rolling element rotatably arranged on the at least one of the pivot arms, which can be guided in a correspondence element, which is arranged, in particular formed, on the lever arm mount of the lever arm and is designed as a slotted guide, for the sequence control of the pivot movement of the pivot mechanism.

According to one preferred embodiment variant, at least one portion of the slotted guide of the first and second coupling unit is designed having an inlet region.

This enables the simple coupling of the roller in the slotted guide.

According to a further preferred embodiment variant, at least one portion of the slotted guide of the second coupling unit is in the form of a partial circle, which ensures an exact sequence control during the raising and lowering of the shelf.

According to a further preferred embodiment variant, a portion of the slotted guide of the first coupling unit is designed as a dead center portion.

Securing the shelf in a raised upper end position is thus enabled in a simple manner by pivoting the lever unit beyond the dead center, in particular without the necessity of locking the sliding-pivoting mechanism in this position. This means that without an additional locking element, a secured upper end position of the shelf is achieved, and it is also possible to leave it again without an additional release element.

According to a further preferred embodiment variant, a portion of the slotted guide of the first coupling unit has a slope adapted to an optimal actuating force curve. This in particular enables raising of the shelf with nearly uniform application of force by the user.

The piece of furniture according to the invention and the household appliance according to the invention are distinguished by a sliding-pivoting mechanism as described above.

BRIEF DESCRIPTION OF THE DRAWING FIGURES

Embodiment variants of the invention are explained in greater detail hereinafter on the basis of the appended drawings. In the figures:

FIG. 1 shows a perspective view of a first embodiment variant of a sliding-pivoting mechanism installed in a household appliance designed as a dishwasher in the position of the lower shelf retracted into the usable space, FIG. 2 shows a side view of the sliding-pivoting mechanism having a shelf fixed thereon in the position shown in FIG. 1, FIG. 3 shows a side view of the left sliding-pivoting mechanism in FIG. 1 with the shelf omitted in the position shown in FIG. 1, FIGS. 4 to 6 show illustrations corresponding to FIGS. 1 to 3 of the household appliance and the sliding-pivoting mechanism after completed displacement of the lower shelf out of the body before the raising of the sliding-pivoting mechanism, FIGS. 7 and 8 show illustrations corresponding to FIGS. 5 and 6 of the sliding-pivoting mechanism according to a slightly modified embodiment variant, FIGS. 9 and 10 show illustrations corresponding to FIGS. 4 and 6 in the slightly raised position of the lower shelf, FIGS. 11 and 12 show illustrations corresponding to FIGS. 9 and 10 in the completely raised position of the lower shelf, FIG. 13 shows a perspective exploded illustration of the sliding-pivoting mechanism according to the embodiment variant shown in FIG. 12, FIGS. 14 to 16 show views corresponding to FIGS. 1 to 3 of an alternative embodiment variant in which two slotted guides are arranged on one of the pivot arms, FIGS. 17 and 18 show illustrations corresponding to FIGS. 14 and 16 after completed displacement of the lower shelf out of the body before the raising of the sliding-pivoting mechanism, FIGS. 19 and 20 show illustrations corresponding to FIGS. 17 and 18 in the slightly raised position of the lower shelf, FIGS. 21 and 22 show illustrations corresponding to FIGS. 19 and 20 of the sliding-pivoting mechanism in the completely raised position of the lower shelf, FIG. 23 shows a perspective exploded illustration of the sliding-pivoting mechanism shown in FIGS. 14 to 22, FIGS. 24 to 26 show views corresponding to FIGS. 1 to 3 of a further embodiment variant of a sliding-pivoting mechanism according to the invention with completely retracted lower shelf, FIGS. 27 and 28 show illustrations corresponding to FIGS. 24 and 26 after completed displacement of the lower shelf out of the body before the raising of the sliding-pivoting mechanism, FIGS. 29 and 30 show a perspective illustration corresponding to FIGS. 27 and 28 in the slightly raised position of the lower shelf, FIGS. 31 and 32 show views corresponding to FIGS. 29 and 30 of the household appliance or the sliding-pivoting mechanism in the completely raised position of the lower shelf, FIG. 33 shows a perspective exploded illustration of the sliding-pivoting mechanism according to FIGS. 24 to 32, FIGS. 34 to 36 show views corresponding to FIGS. 1 to 3 of a further embodiment variant of a sliding-pivoting mechanism according to the invention with completely retracted lower shelf, FIGS. 37 and 38 show illustrations corresponding to FIGS. 34 and 36 after completed displacement of the lower shelf out of the body before the raising of the sliding-pivoting mechanism, FIGS. 39 and 40 show a perspective illustration corresponding to FIGS. 37 and 38 in the slightly raised position of the lower shelf, FIGS. 41 and 42 show views corresponding to FIGS. 39 and 40 of the household appliance or the sliding-pivoting mechanism in the completely raised position of the lower shelf, FIGS. 43 and 44 show views corresponding to FIGS. 39 and 40 of the household appliance or the sliding-pivoting mechanism in the completely raised position of the lower shelf with an additional third shelf, FIG. 45 shows a perspective exploded illustration of the sliding-pivoting mechanism according to FIGS. 34 to 44.

DETAILED DESCRIPTION

In the following description of the figures, terms such as top, bottom, left, right, front, rear, etc. relate exclusively to the illustration and position selected by way of example in the respective figures of the sliding-pivoting mechanism, shelf, pivot arms, lever unit, pullout guide, and the like. These terms are not to be understood as restrictive, i.e., these references can change due to different operating positions or mirror symmetrical design or the like.

A first embodiment variant of a sliding-pivoting mechanism according to the invention is shown in FIGS. 1 to 13, using which a lower shelf 9, in the form of a dish rack here, can be raised out of the interior or usable space 22 of a household appliance, designed here as a dishwasher 1, from an pushed-in lower position into a loading and unloading position, which is pulled out of the usable space and pivoted upward.

FIGS. 14 to 23 show an alternative second embodiment variant of such a sliding-pivoting mechanism, in which a first pivot lever 41 and a second pivot lever 42 are not aligned vertically in a lowered starting position, as in the variant according to FIGS. 1 to 13, but rather are aligned inclined forward at an angle of approximately 20°.

This angled alignment of the pivot levers 41, 42 offers the advantage over the first embodiment variant that a greater pullout distance is thus enabled in the lower position, without the shelf 9 protruding too far forward in the upper end position. The access to the shelf 9 in the lower extended position is thus improved, without the distance of the shelf 9 from the body 2 in the completely raised position differing from the position in the first embodiment variant. In addition, the angled alignment offers the advantage that due to the changed pivot path, taller objects can be placed in the shelf without a collision occurring with the lever unit 5.

A middle rail between the guide rail 31 and the slide rail 32 is conceivable, but not necessary. The stability and the pullout distance of the pullout guide can be increased by an additional middle rail.

Figure 1:
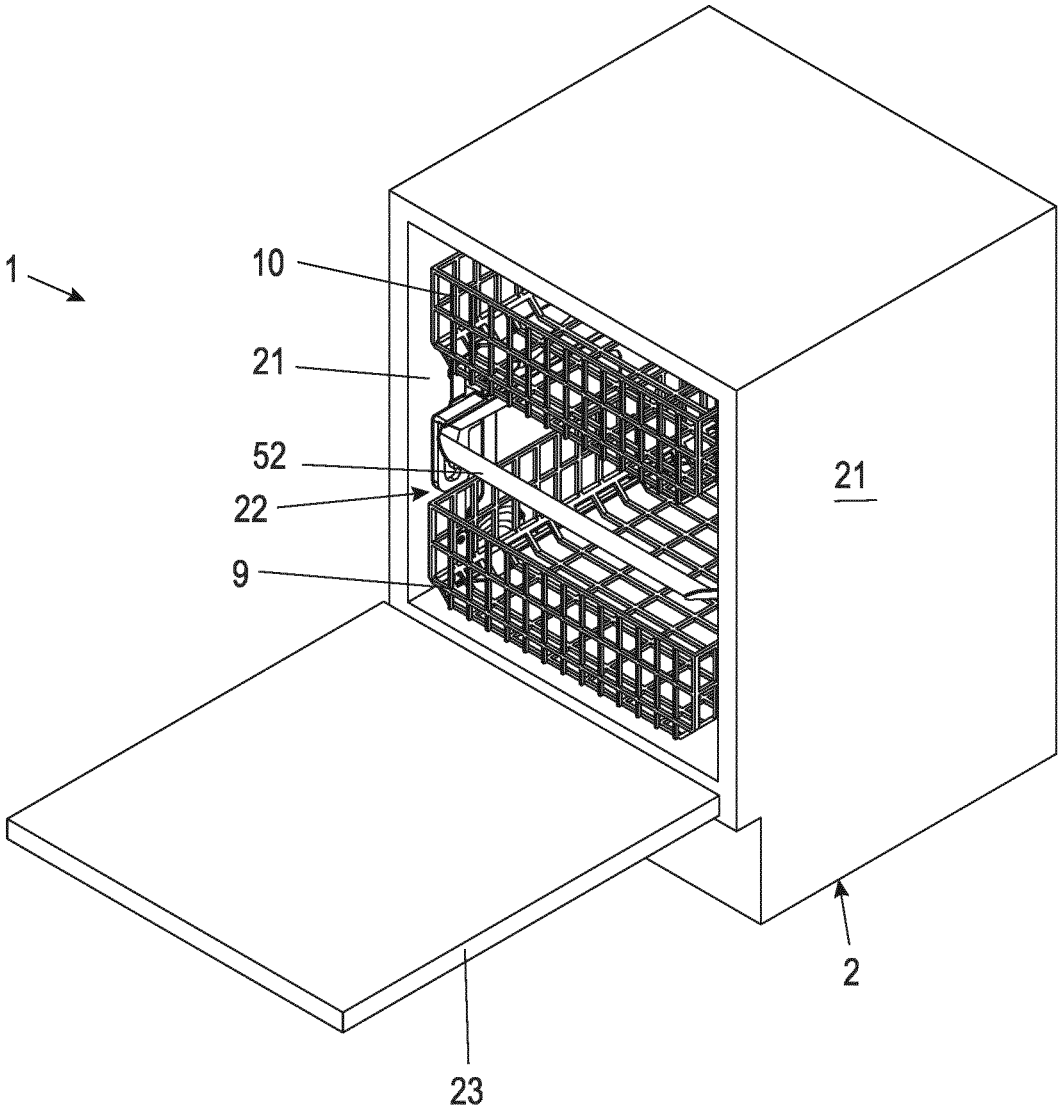

All variants share the feature of the fundamental structure of the pullout guide 3 having a guide rail 31 and a slide rail 32 linearly displaceable therein, on which the lower shelf 9 is fastened.

As shown, for example, in FIGS. 1, 14, 24, and 34, in addition to the lower shelf 9, an upper shelf 10 arranged above it is arranged in the usable space 22 of the household appliance designed here as a dishwasher 1, which can be pulled via a further pullout guide (not shown here) out of the usable space 22 of the body 2 of the dishwasher 1.

The same arrangement is also conceivable for one shelf 9 or two shelves 9, 10, arranged in a piece of furniture or another household appliance, for example, a cooking appliance, such as an oven or the like or a refrigerator.

As is furthermore shown in FIGS. 1, 14, 24, and 34, a sliding-pivoting mechanism is preferably arranged on each of the side walls 21 of the piece of furniture or household appliance to be able to sufficiently support a shelf 9 like the dish rack shown here.

In principle, however, arranging only one sliding-pivoting mechanism in the usable space of the piece of furniture or household appliance would also be conceivable, for example, for fixing a board-like shelf or the like having comparatively less carrying capacity.

All variants additionally share the feature of the fundamental structure of the pivot mechanism 4. The pivot mechanism 4 has, as shown in FIGS. 2, 15, 25, and 35, in each case two pivot arms 41, 42 rotatably fixed on a side wall 21 having a first end parallel to the plane of the side walls 21 and arranged spaced apart in parallel to one another. The pivot arms 41, 42 are rotatably fixed on a side wall mount 43 via respective pivot joints 412, 422 on the side wall mount 43.

The guide rail 31 of a respective pullout guide 3 is fixed on the respective second ends of the pivot arms 41, 42 via pivot joints 411, 412.

The second pivot arm 42 is preferably connected via a force accumulator 6, for example, in the form of a coiled spring or gas pressure spring, to the side wall mount 43 in such a way that by pivoting the second pivot arm 42, the raising and/or lowering of the pivot mechanism 4 is assisted by the force accumulator 6. Additionally or alternatively, the force accumulator 6 can also have a damper.

Furthermore, all embodiment variants of the sliding-pivoting mechanism have a lever unit 5, which assists raising and lowering of the pivot mechanism 4 and is pivotably fixed on the slide rail 32 in parallel to the plane of the side walls 21.

At least one coupling element of a first coupling unit 7 is arranged on the lever unit 5 in such a way that the coupling element can be coupled with a correspondence element, which corresponds to the coupling element, of the first coupling unit 7 of at least one of the pivot arms 41, 42 by displacing the slide rail 32 into a predetermined pivot position.

All of the embodiment variants furthermore have a second coupling unit 8, wherein at least one coupling element of this second coupling unit 8 is arranged on the slide rail 32 or the shelf 9 in such a way that the coupling element can be coupled with a correspondence element, which corresponds to the coupling element, of the second coupling unit 8 of at least one of the pivot arms 41, 42 by displacing the slide rail 32 into a predetermined pivot position.

Each of the coupling units 7, 8 preferably has in the embodiment variants shown here a roller 71, 81 and a slotted guide 72, 82, in which the respective roller 71, 81 can be guided.

The main task of the slotted guide 82 in this case is to prevent an uncontrolled rail movement during the pivoting.

The slotted guide 72 can advantageously be designed here so that it has at least one sliding surface, in particular a raised surface, for guiding the lever arm 51 during the pullout movement, so that grinding of the lever arm 51 on the slotted guide 72 or on the pivot arms 41, 42 is prevented.

Figure 26:
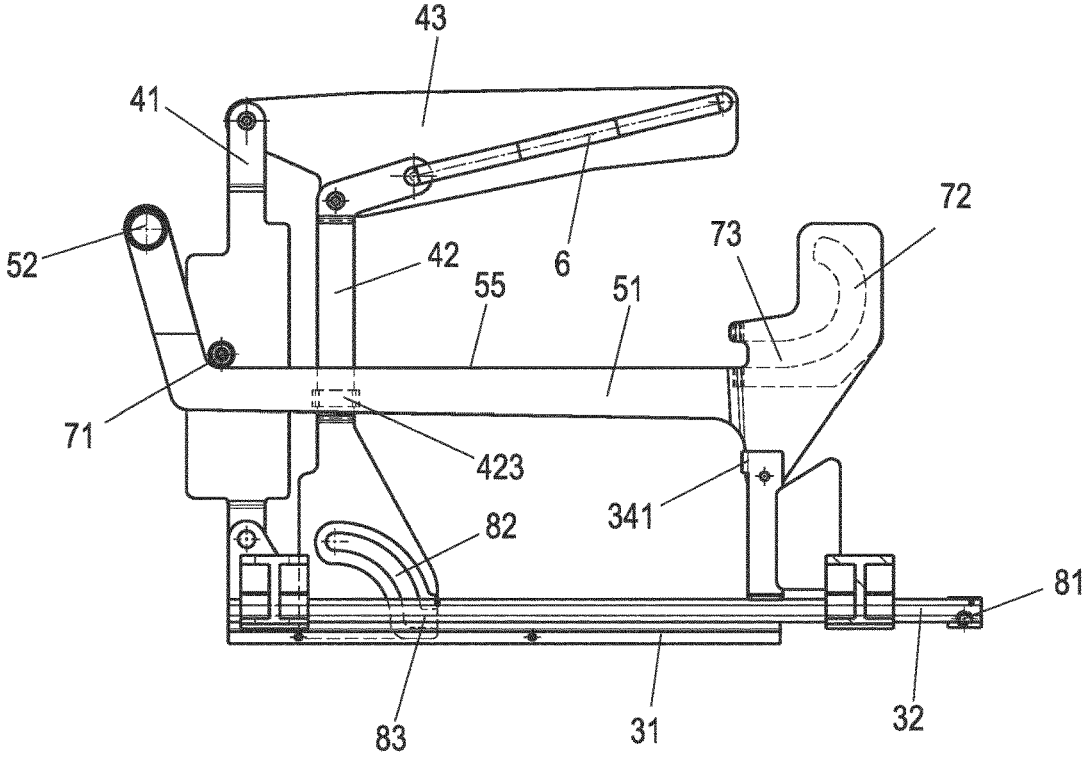
Figure 33:
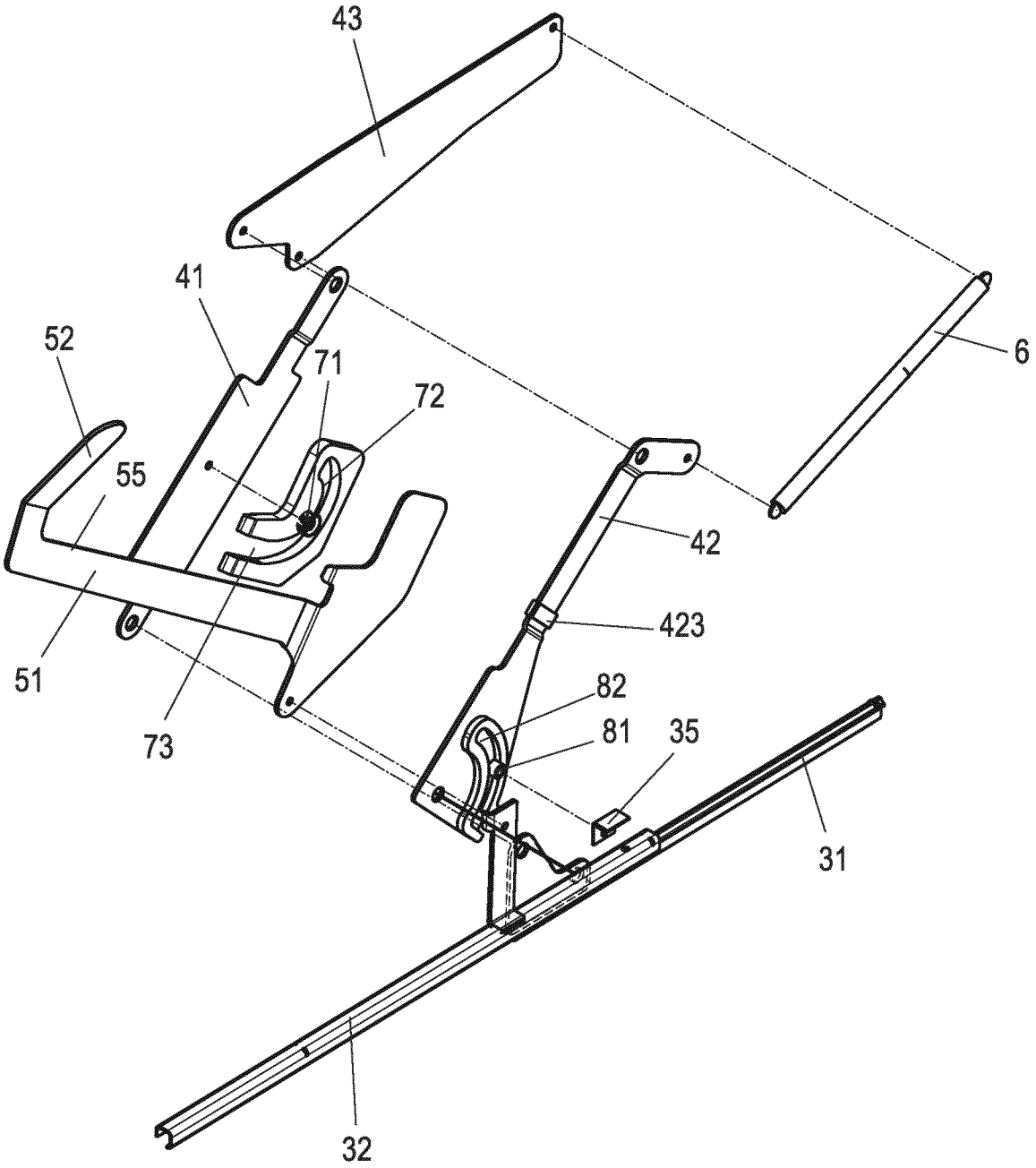

Alternatively, the at least one sliding surface 423 can also be arranged on one of the pivot arms 41, 42, as shown by way of example in FIGS. 26 and 33.

Figure 2:
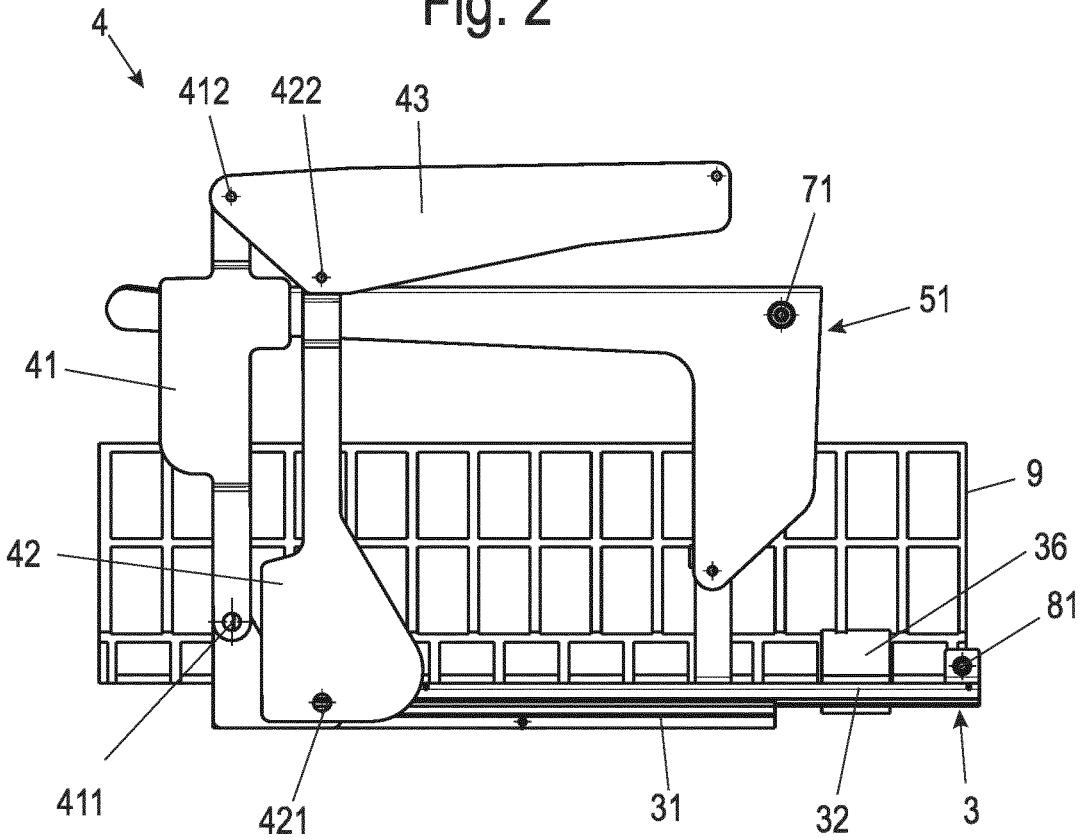
Figure 15:
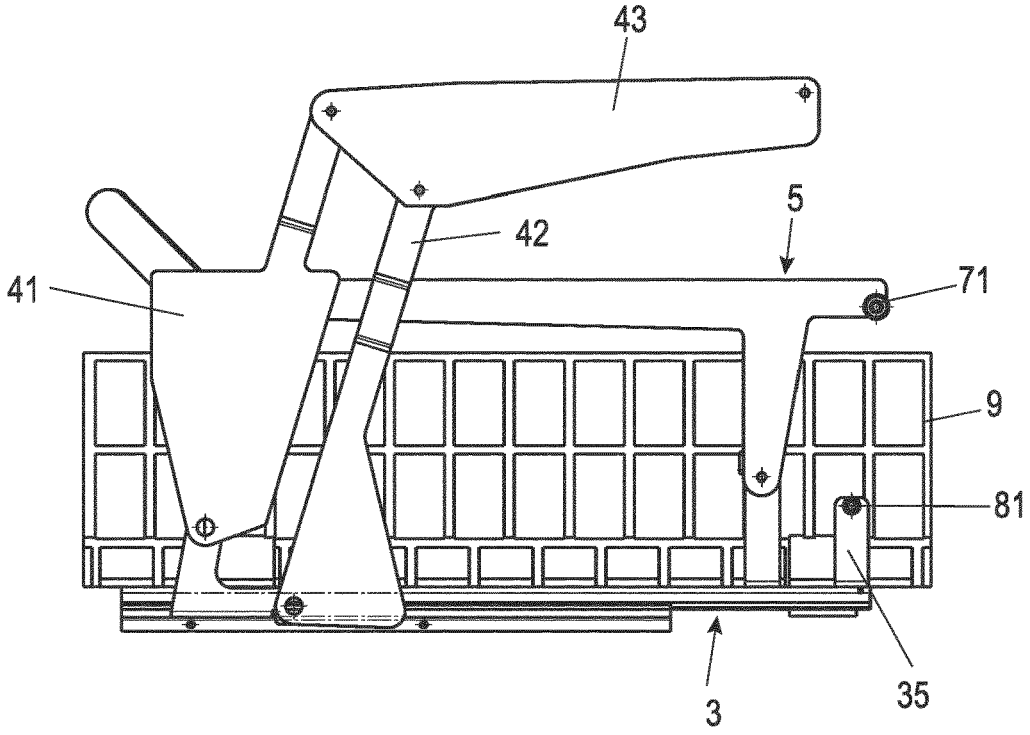
Figure 25:
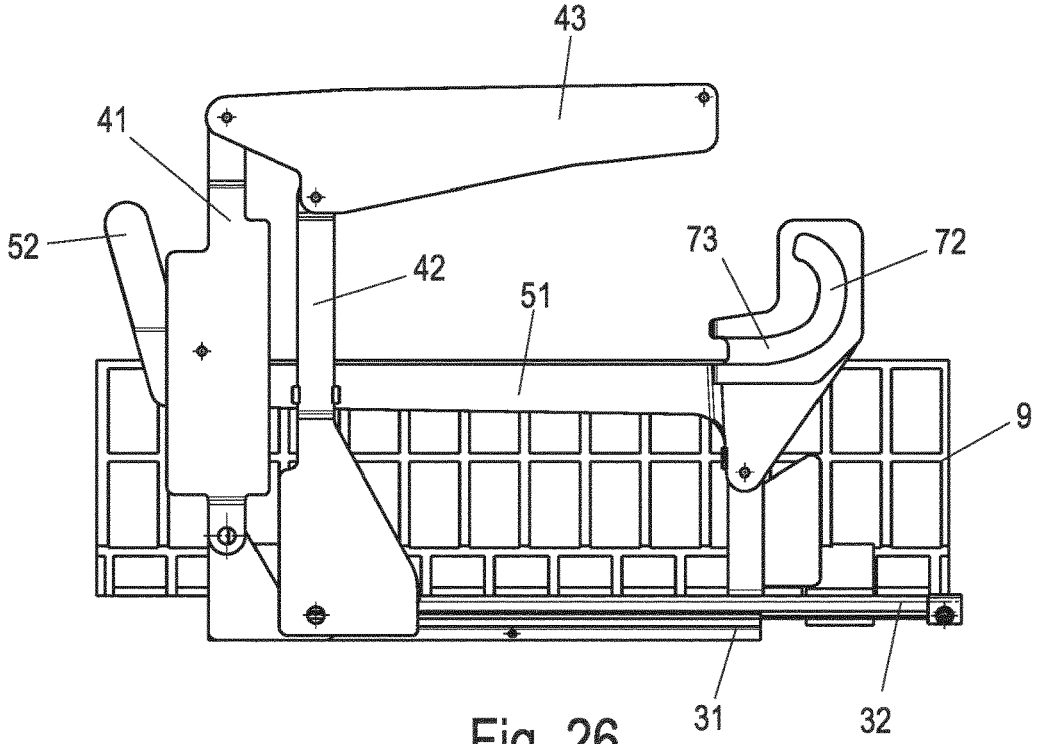

In the first three embodiment variants, as can be seen in FIGS. 2, 15, and 25, the roller 81 of the second coupling unit 8 is fastened on the slide rail 32. The roller 81 is preferably fastened here in a rear region of the slide rail 32 in the pullout direction x on a roller mount 35 protruding upward in the direction of the side wall mount 43.

All embodiment variants share the feature of a lever arm mount 34 arranged on the slide rail 32, on which the lever arm 51 is rotatably fixed.

In the front region, the lever arm mount has a stop 341, on which the lever arm 51 stops in its lower position, and which prevents the lever arm 51 from being lowered too far. For this purpose, a corresponding projection or a corresponding bend is preferably provided on the lever arm 51.

It is also ensured in all embodiment variants by the design of the slotted guide 72 having a top dead center region that the lever arm 51 cannot be pivoted farther in the direction of the body in the raised end position. A collision of the lever unit 5 with the body is thus prevented.

Details of the first embodiment variants are described hereinafter on the basis of FIGS. 1 to 13.

Figure 3:
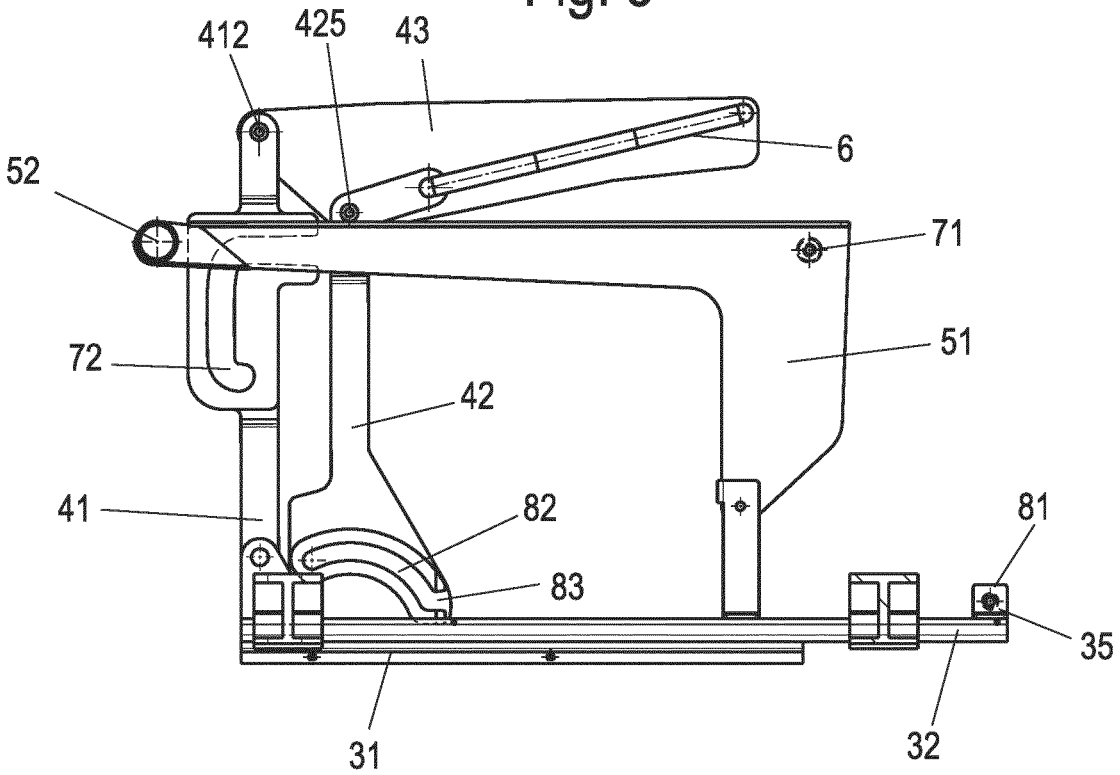

In the first embodiment variants shown in FIGS. 1 to 13, as can be seen in FIGS. 2 and 3, the coupling element of the first coupling unit 7 is designed as a roller 71, which is fastened in a rear region in the pullout direction x of a lever arm 51 of the lever unit 5.

A front end of the lever unit 5 is designed as an actuating handle 52. The actuating handle 52 preferably connects the lever arms 51 of the respective sliding-pivoting mechanism, which are arranged on both sides of the shelf 9.

In this exemplary embodiment, the lever arm 51 has an angled edge 55 to increase the stability in the upper region. The upper edge 55 of the lever arm 51 forms, together with a stop 413 arranged on the first pivot arm 41, a guide region, whereby the shelf 9 is prevented from pivoting up during the extension movement.

Accordingly, the slotted guide 72 of the first coupling unit 7 is formed here in a correspondingly broadly embodied section of the first pivot arm 41 on the first pivot arm 41 of the pivot mechanism 4.

It is also conceivable to form the slotted guide 72 as a separate component and to fasten it on the pivot arm 41.

To enable the roller 71 to slide past the second pivot arm 42 during the pullout movement of the lower shelf 9 out of the usable space 22 of the body 2, the second pivot arm 42 has a bead 424 in a region of the pivot arm 42 corresponding to the installation height of the roller 71, so that the lever arm 51 can pass the second pivot arm 42 without striking it.

Figure 4:
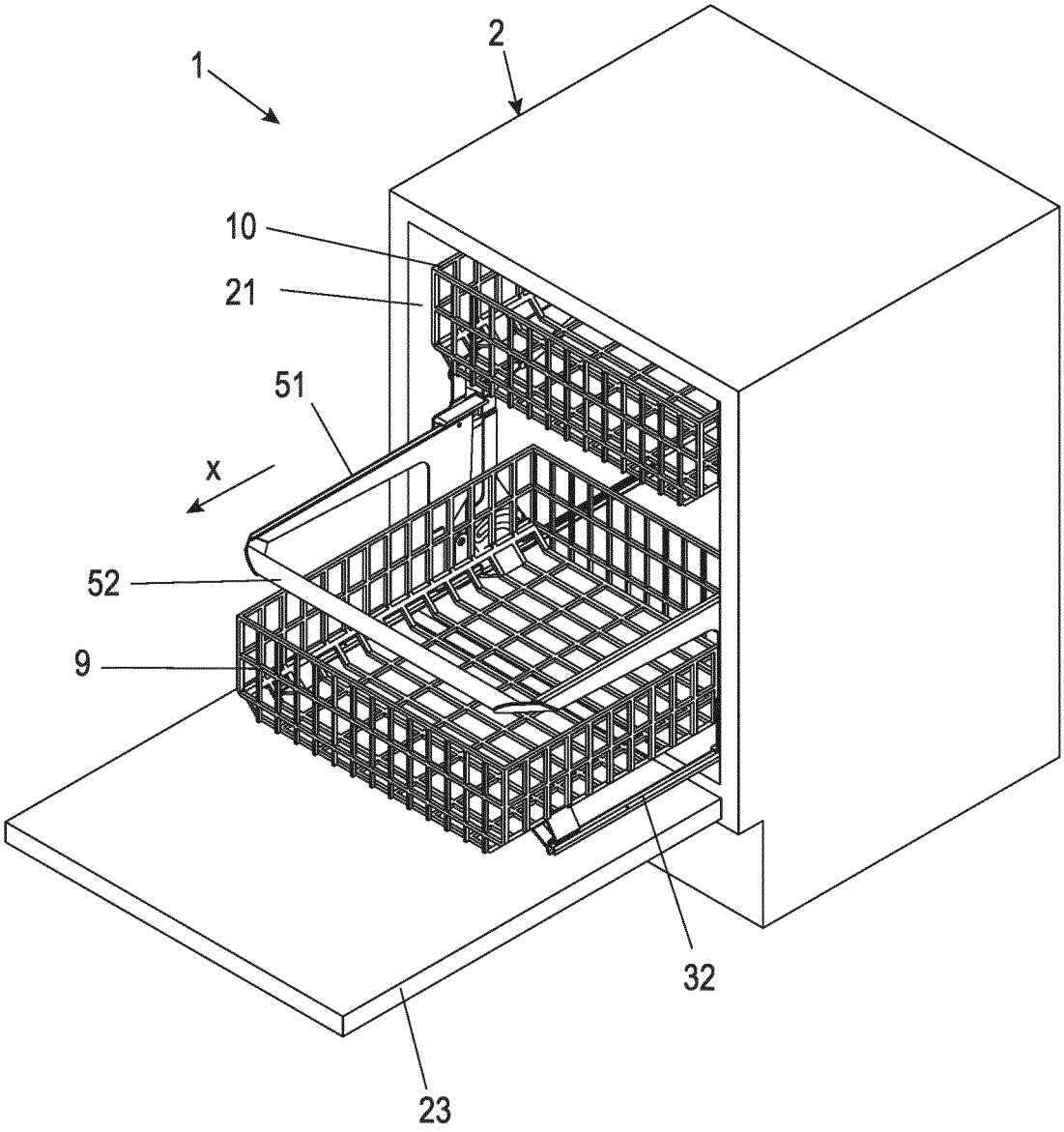
Figure 5:
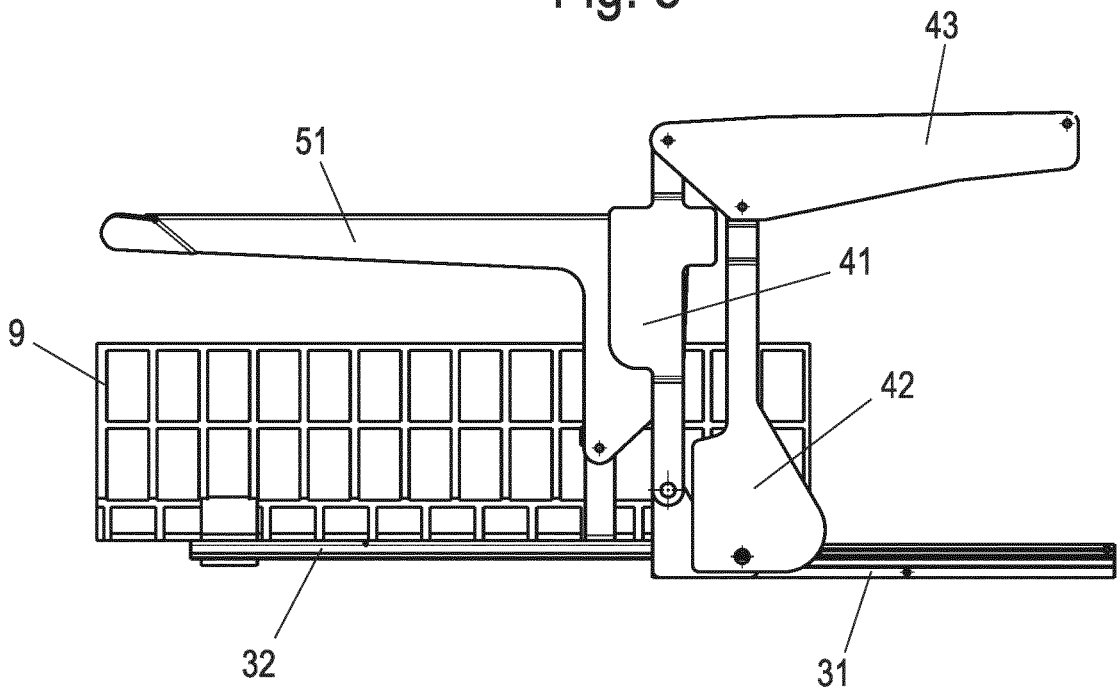
Figure 6:
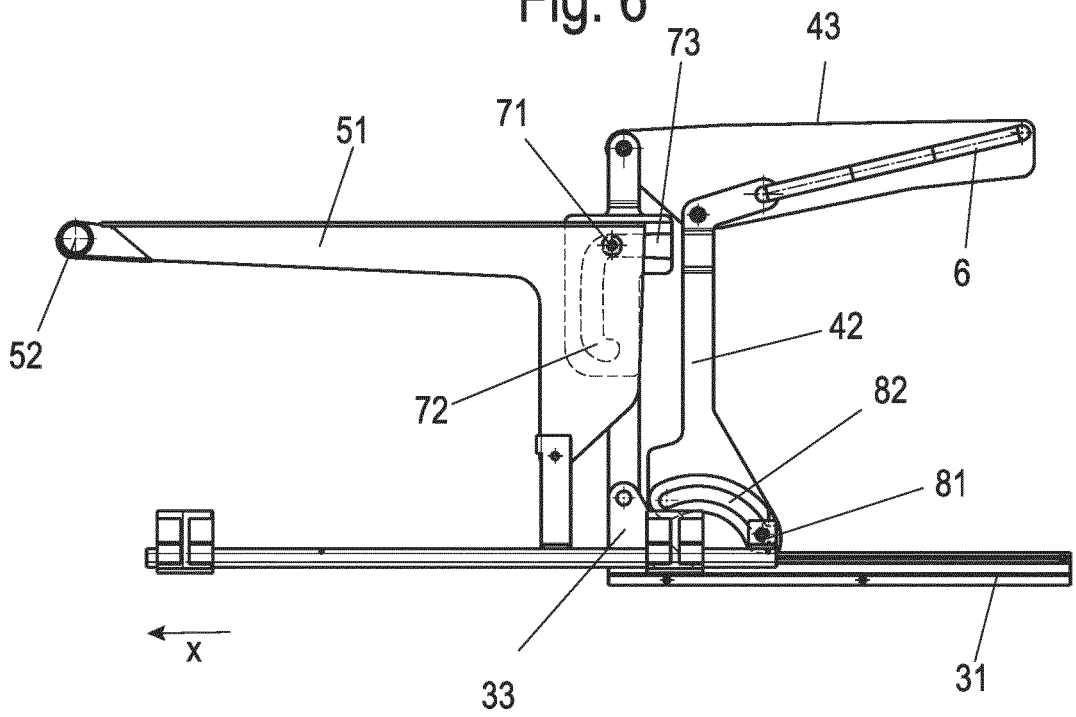
Figure 7:
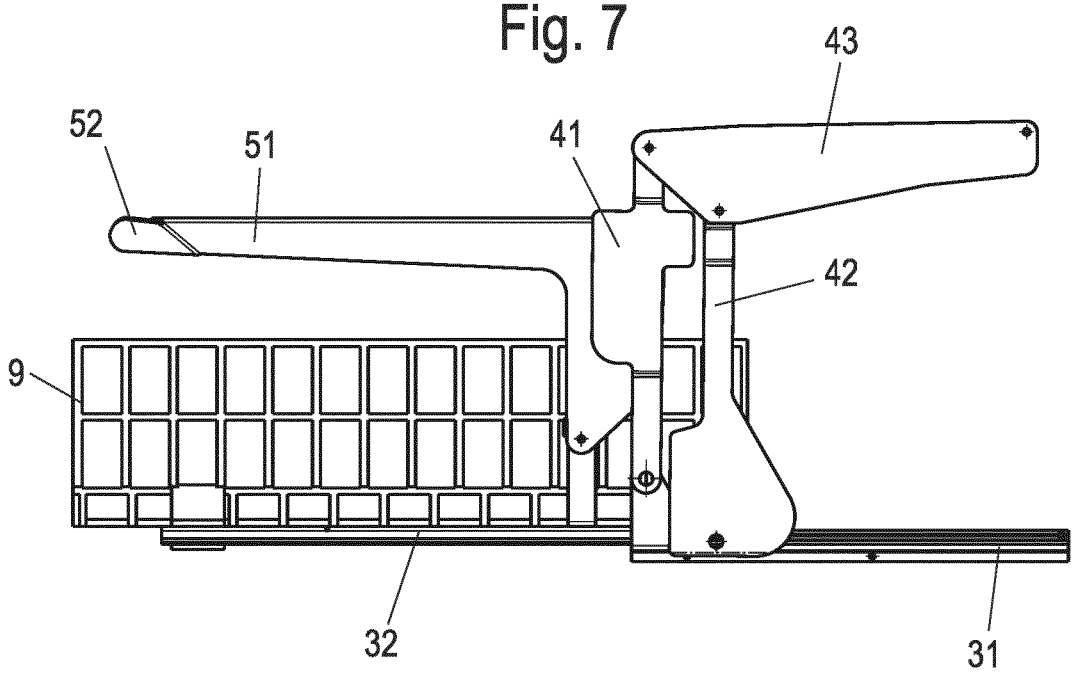
Figure 8:
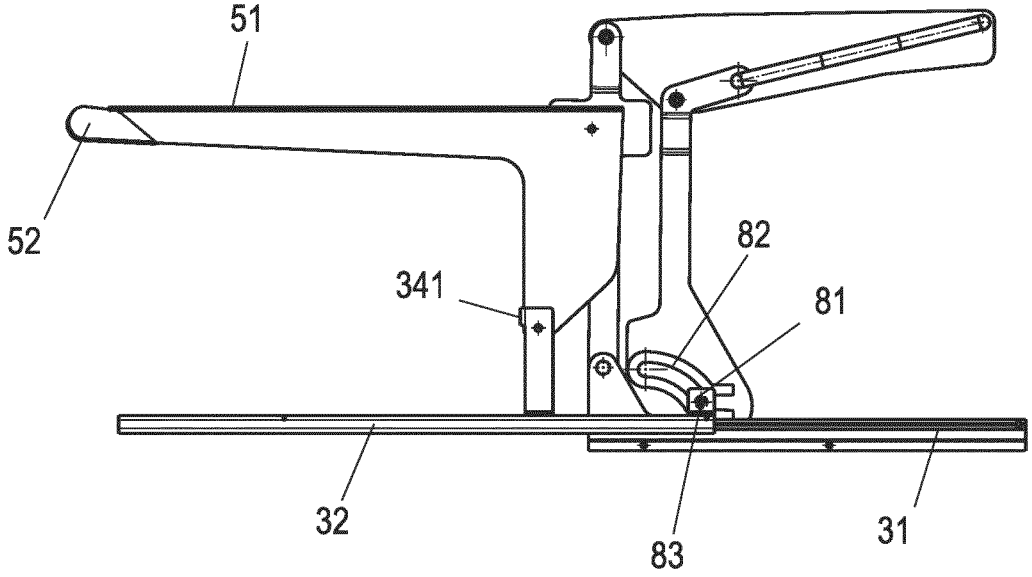

The predetermined pivot position, in which the coupling element and the correspondence element of the first coupling unit 7 establish an operational connection to one another, is shortly before reaching the position shown in FIGS. 4 to 6, in which the shelf 9 is displaced out of the usable space 22 of the body 2 into a position in which the shelf 9 can be raised with the aid of the pivot mechanism 4.

As is shown in particular in FIG. 6, in this position, the roller 71 of the first coupling unit 7 is retracted into the slotted guide 72 of the first coupling unit 7. At the same time, the roller 81 of the second coupling unit 8 is retracted into the slotted guide 82 of the slotted guide 82 of the second coupling unit 8, which is formed here on the second lever arm 42.

To enable simple threading of the rollers 71, 81 into the slotted guides 72, 82, the slotted guides 72, 82 preferably each have an inlet region 73, 83, which can be formed rounded or funnel-shaped on the end face. Shortly before the completely extended position of the shelf 9 is reached, the inlet region 73 takes over securing the lever arm 51 against pivoting up too early.

The inlet regions 73, 83 can be dimensioned in different lengths here depending on the requirement. Thus, in particular FIG. 3 shows a second coupling unit 8 having a relatively short inlet region 83, while in an alternative subvariant, shown in FIG. 8, the inlet region 83 is dimensioned somewhat longer, whereby the shelf 9 as a whole can be extended somewhat farther out of the usable space 22 of the body 2 in the pullout direction x.

Due to the particular formation of the slotted guide 82 having a relatively long inlet region 83, the shelf 9 is moved opposite to the pullout direction x during the pivoting up.

A good access to the lower shelf 9 is thus enabled in the lower extended position of the sliding-pivoting mechanism, without the shelf 9 protruding beyond a door 23 of the dishwasher 1 during the pivoting up.

While the slotted guide 82 of the second coupling unit 8 has a portion shaped like a partial circle adjoining the inlet region 83 (in all of the four embodiment variants), the slotted guide 72 of the first coupling unit 7 in the first embodiment variant is shaped in such a way that a portion extending essentially vertically downward, at the end of which a dead center section angled perpendicularly thereto in turn extends, extends on the horizontally extending inlet region 73.

The slotted guide 82 can also be embodied as a straight line or as a free-form curve, whereby the running path of the slide rail 32 during the pivoting up can be controlled as needed. With a formation as a circular path, only the fixing of the slide rail on one of the two pivot levers 41, 42 takes place.

Figure 11:
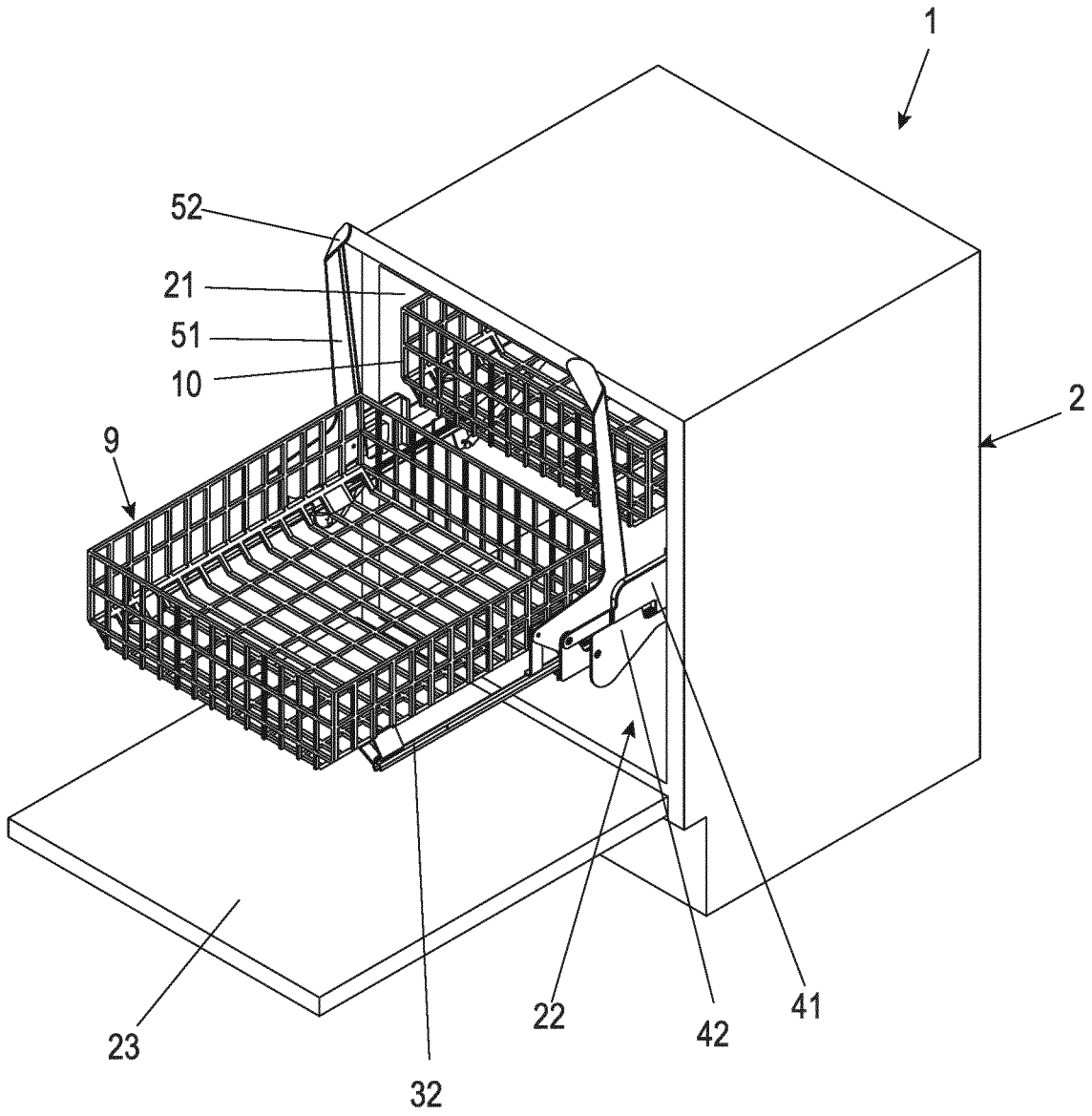
Figure 12:
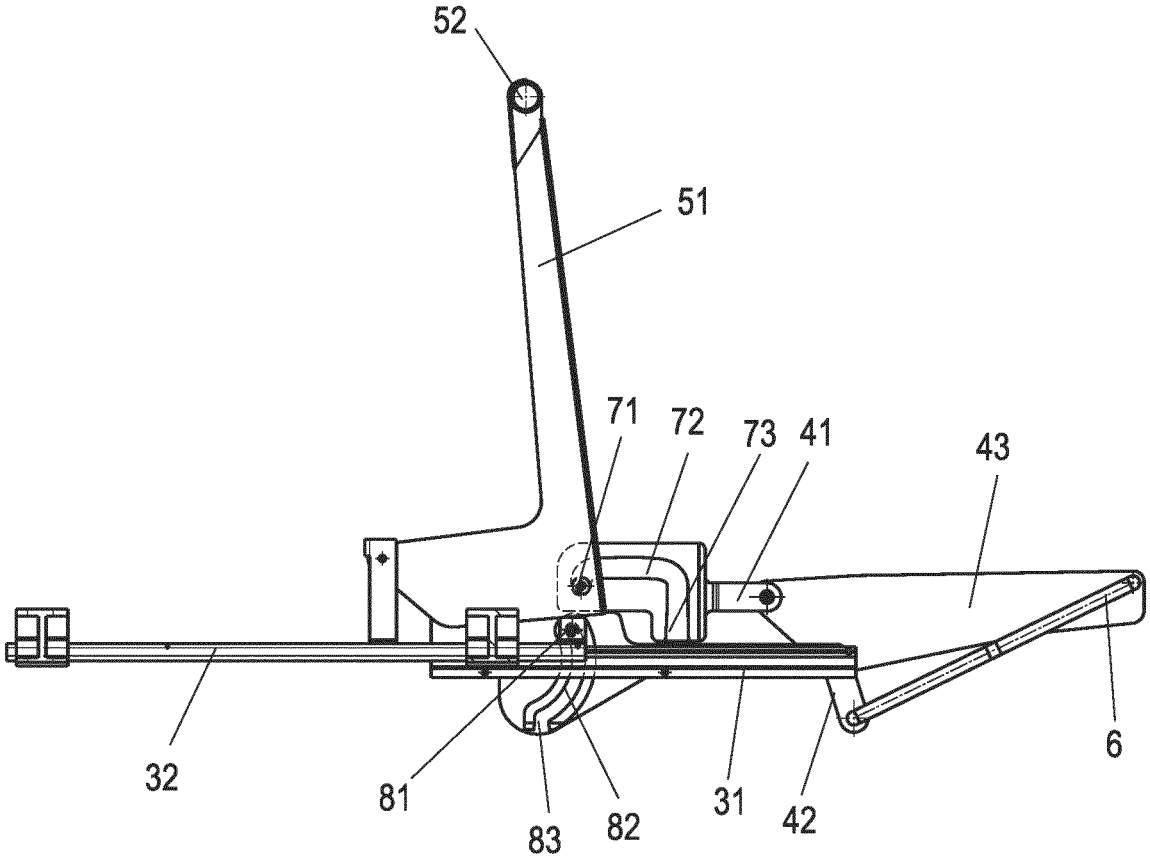
Figure 13:
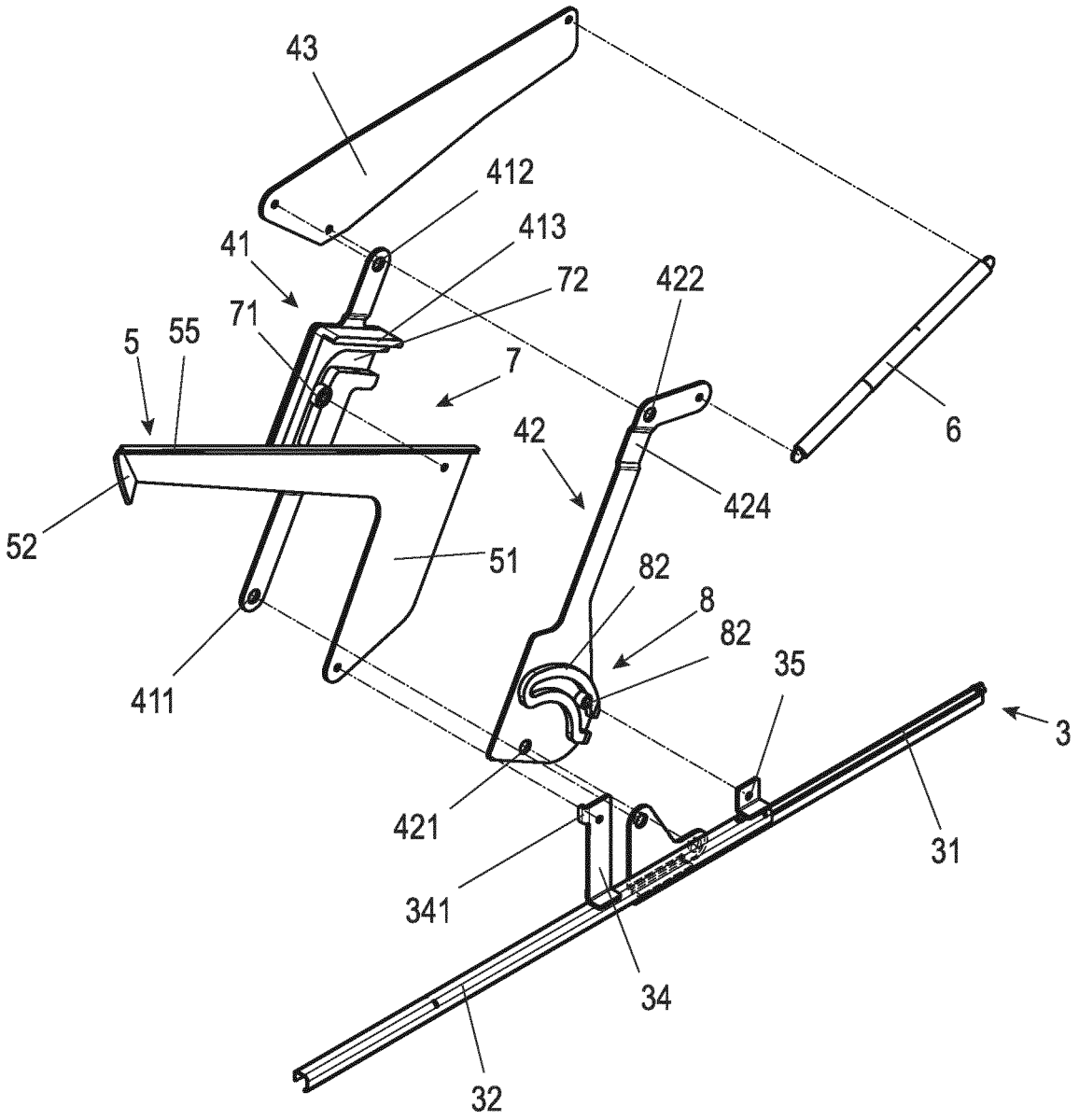

This dead center section is used to hold the shelf 9 without force in its upper raised end position shown in FIGS. 11 and 12, so that the shelf 9 remains in this position without further actuation by a user.

The formation of the slotted guide 72 is primarily oriented toward a slope adapted to an optimum actuating force curve. In this case, the actuating force during the pivot process can be optimized by a deliberate change of the shaping of the slotted guide 72 to the application and the available pivot range.

Figure 9:
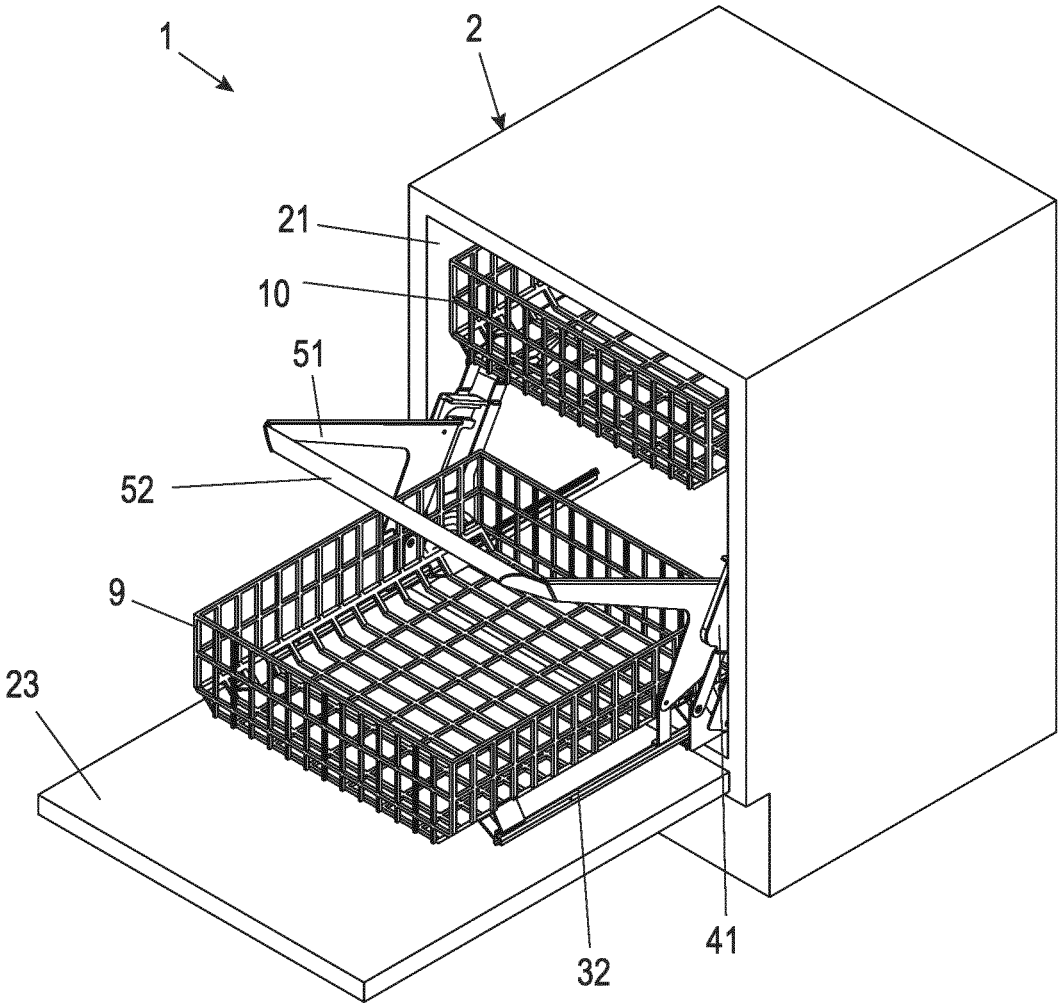
Figure 10:
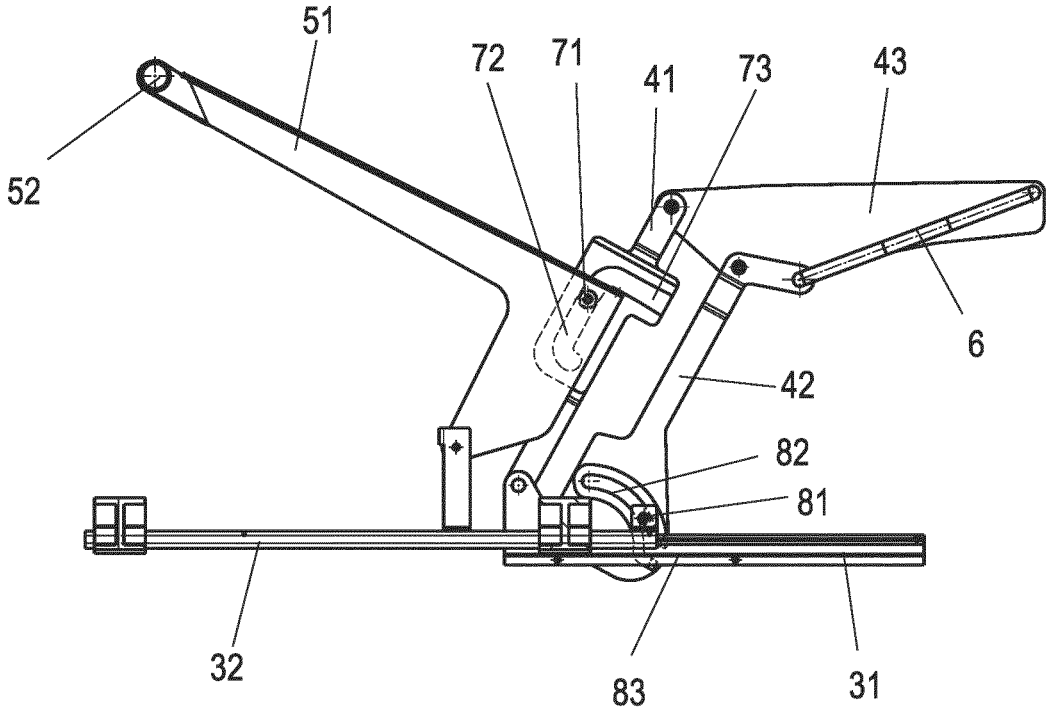

FIGS. 9 and 10 show the dishwasher and the pivot mechanism 4 in the slightly raised position, in which the roller 71 of the first coupling unit 7 has already entered the next section from the inlet region 73, while the roller 81 of the second coupling unit 8 is positioned at the transition to the section shaped like a partial circle.

Details of the second embodiment variant are described hereinafter on the basis of FIGS. 14 to 23.

In contrast to the variant shown in FIGS. 1 to 13, in the variant shown in FIGS. 14 to 23, the slotted guide 82 of the second coupling unit 8 is formed on the same pivot arm 41 as the slotted guide 72 of the first coupling unit 7.

The edge 55 of the lever arm 51 and the stop 413 on the first pivot arm 41 also form a safeguard against the lever arm 51 being raised too early during the extension of the shelf 9 in this variant.

Figure 14:
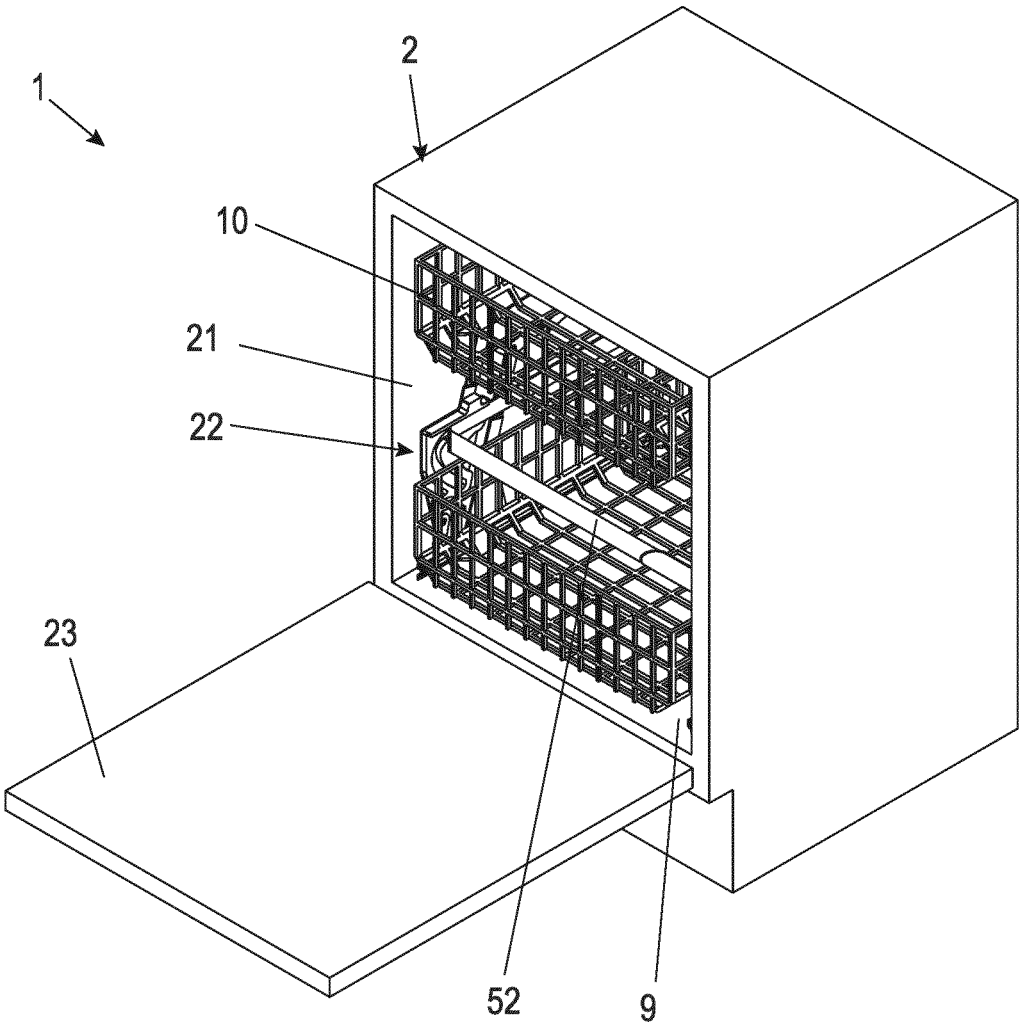
Figure 16:
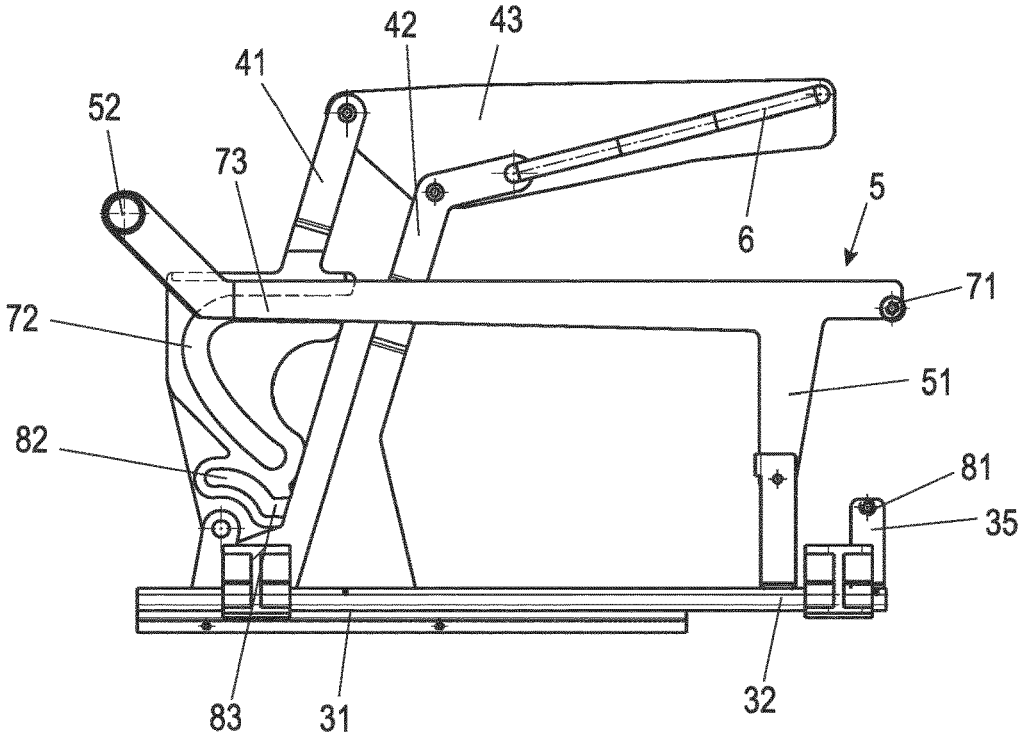

In addition, the pivot arms 41, 42 are not vertically oriented in the lowered position of the shelf 9, as shown in FIGS. 14 to 16, but rather are arranged inclined at an angle of 1° to 60°, preferably 10° to 30° in the pullout direction, which enables the shelf 9 to be moved farther out of the usable space 22 of the body 2 of the dishwasher than with a vertical arrangement of the pivot arms 41, 42.

Figure 17:
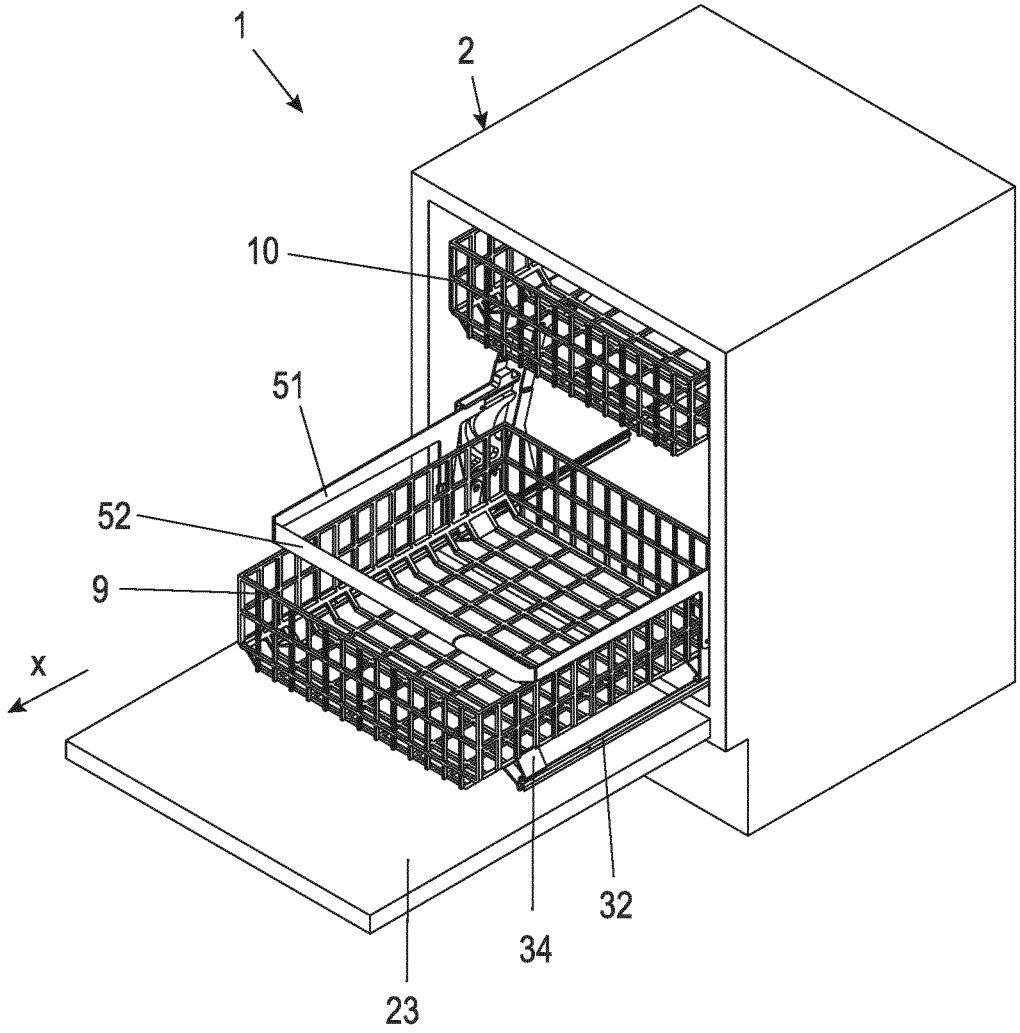
Figure 18:
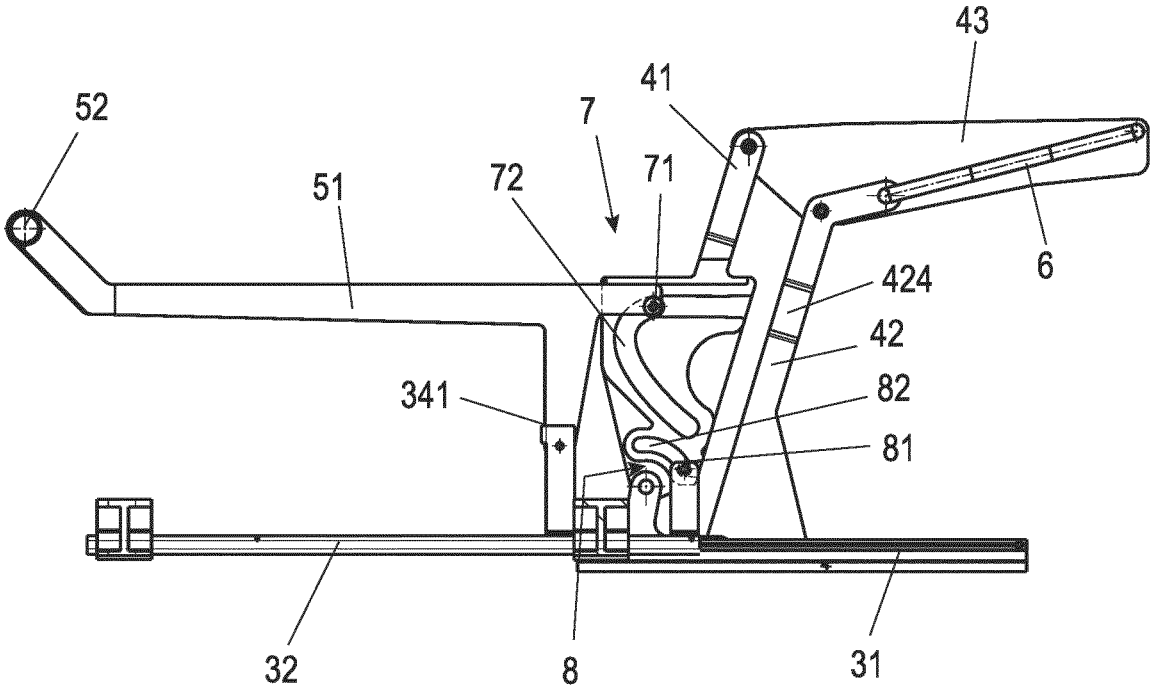

The completely extended, although not raised position of the shelf 9 and the sliding-pivoting mechanism is also shown here in FIGS. 17 and 18, in which the roller 71 of the first coupling unit 7 has entered the inlet region 73 of the slotted guide 72 and accordingly the roller 81 of the second coupling unit 8 has also entered the inlet region 83 of the second slotted guide 82. The slotted guide 72 is formed as a curve having varying curve radius in this embodiment variant.

Figure 19:
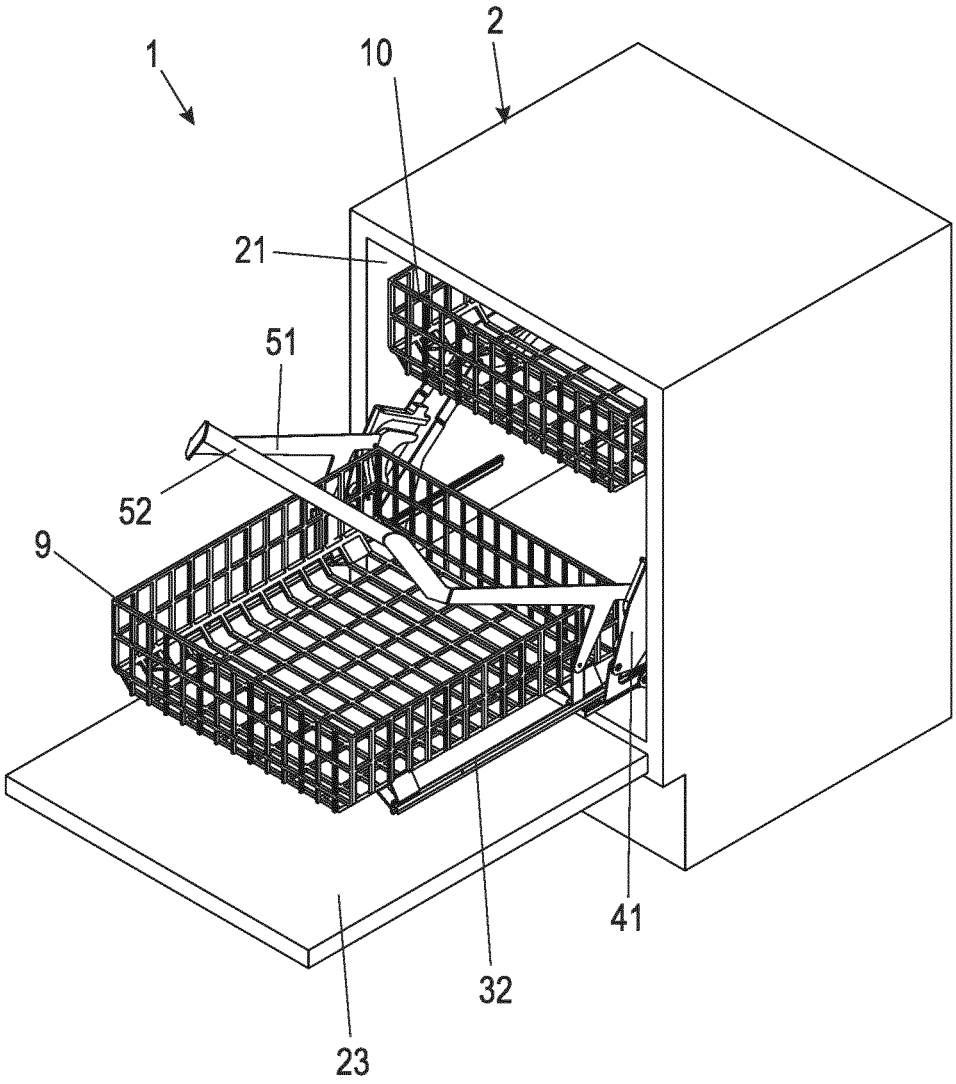
Figure 20:
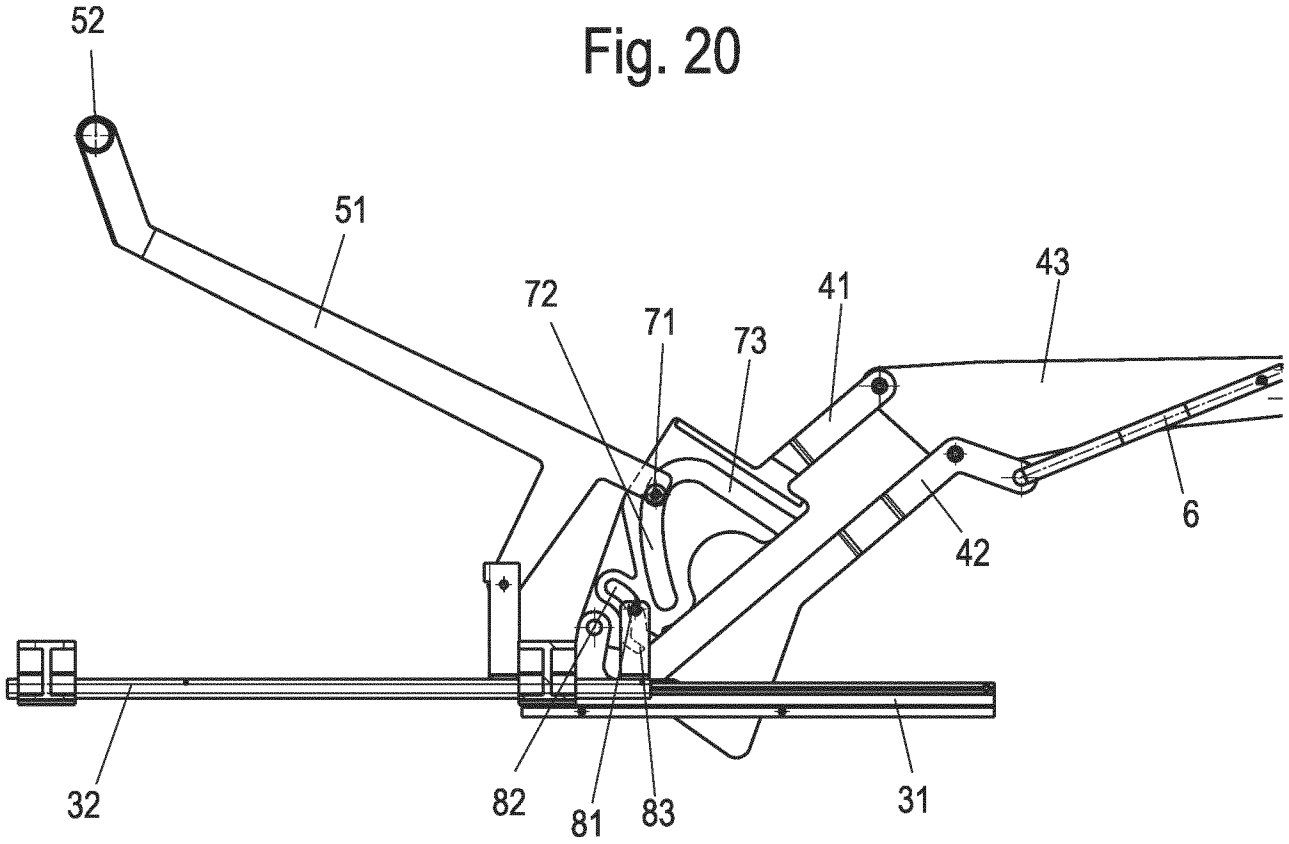

FIGS. 19 and 20 show the second embodiment variant of this sliding-pivoting mechanism in the slightly raised position of the shelf 9, in which the rollers 71, 81 have entered the curve region of the slotted guide 72 of the first coupling unit 7 and the region shaped like a partial circle of the slotted guide 82 of the second coupling unit 8.

Figure 21:
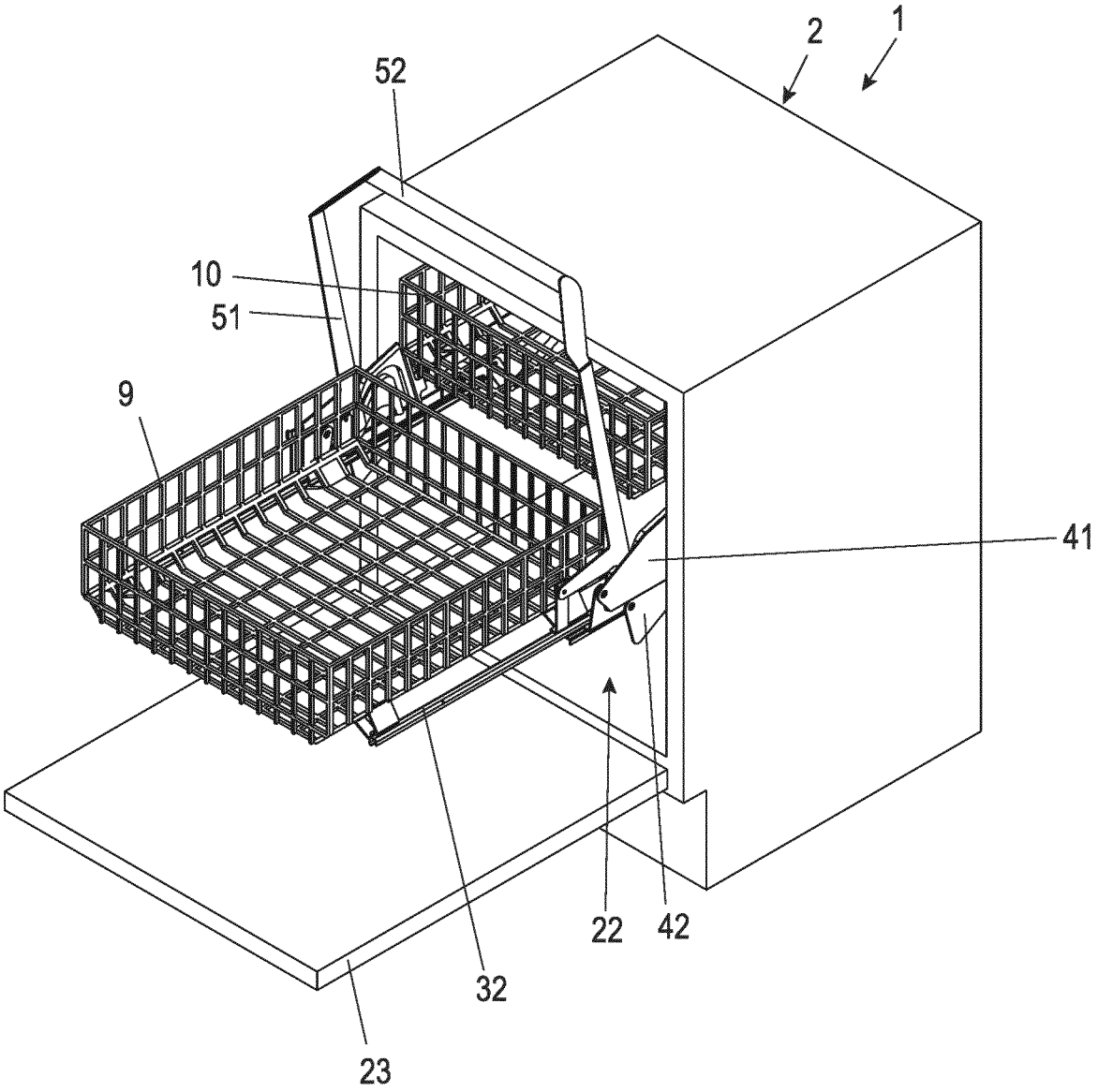
Figure 22:
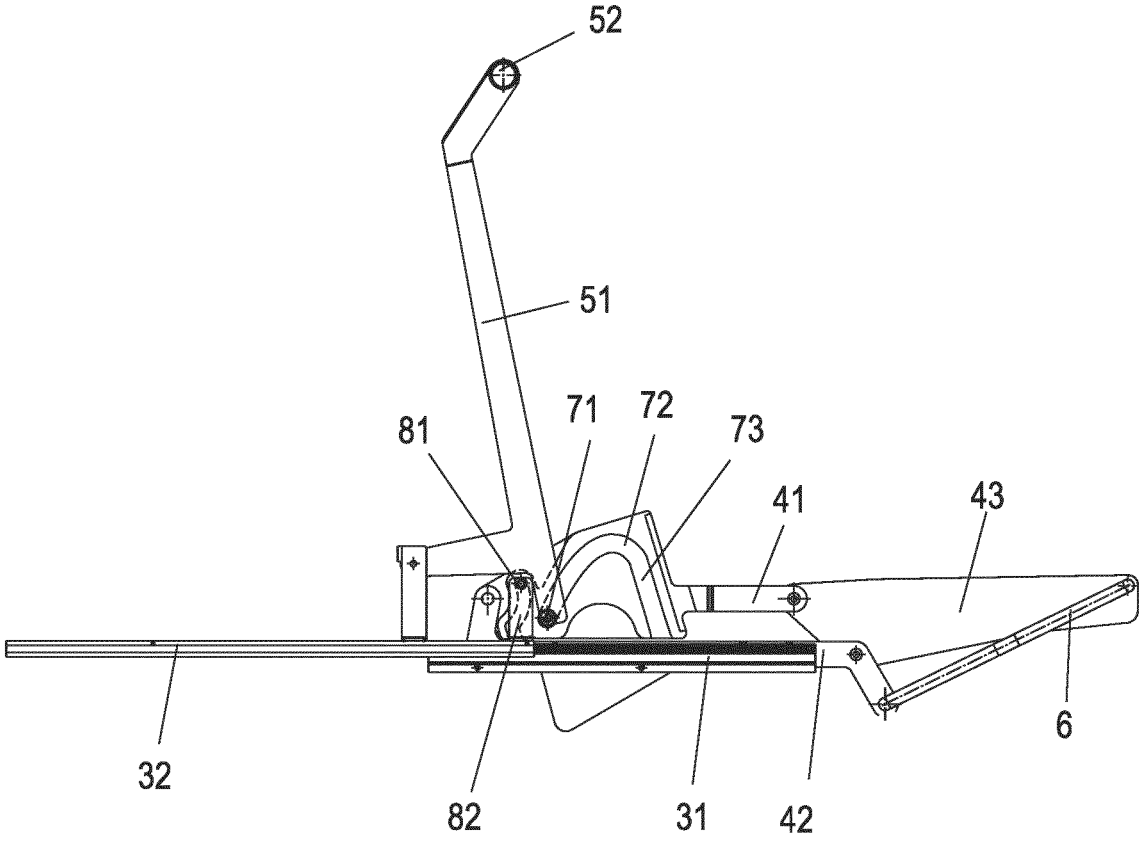

FIGS. 21 and 22 show the raised end position of the sliding-pivoting mechanism, in which the rollers 71, 81 have arrived at the rear end of the respective slotted guide 72, 82.

The slotted guide 72 is also shaped in this embodiment variant so that in the raised end position, the shelf 9 remains in a secure position without additional locking and is only lowered again by actuating the lever unit 5.

Due to the embodiment of the slotted guide 72 as a curve having varying curve radius, it is possible to implement a fluid transition into the dead center region, which is advantageous over the first embodiment variant.

The path between dead center and secure end position can be adapted in a simple manner by the individual design of the slotted guide 72 close to the dead center region.

Figure 23:
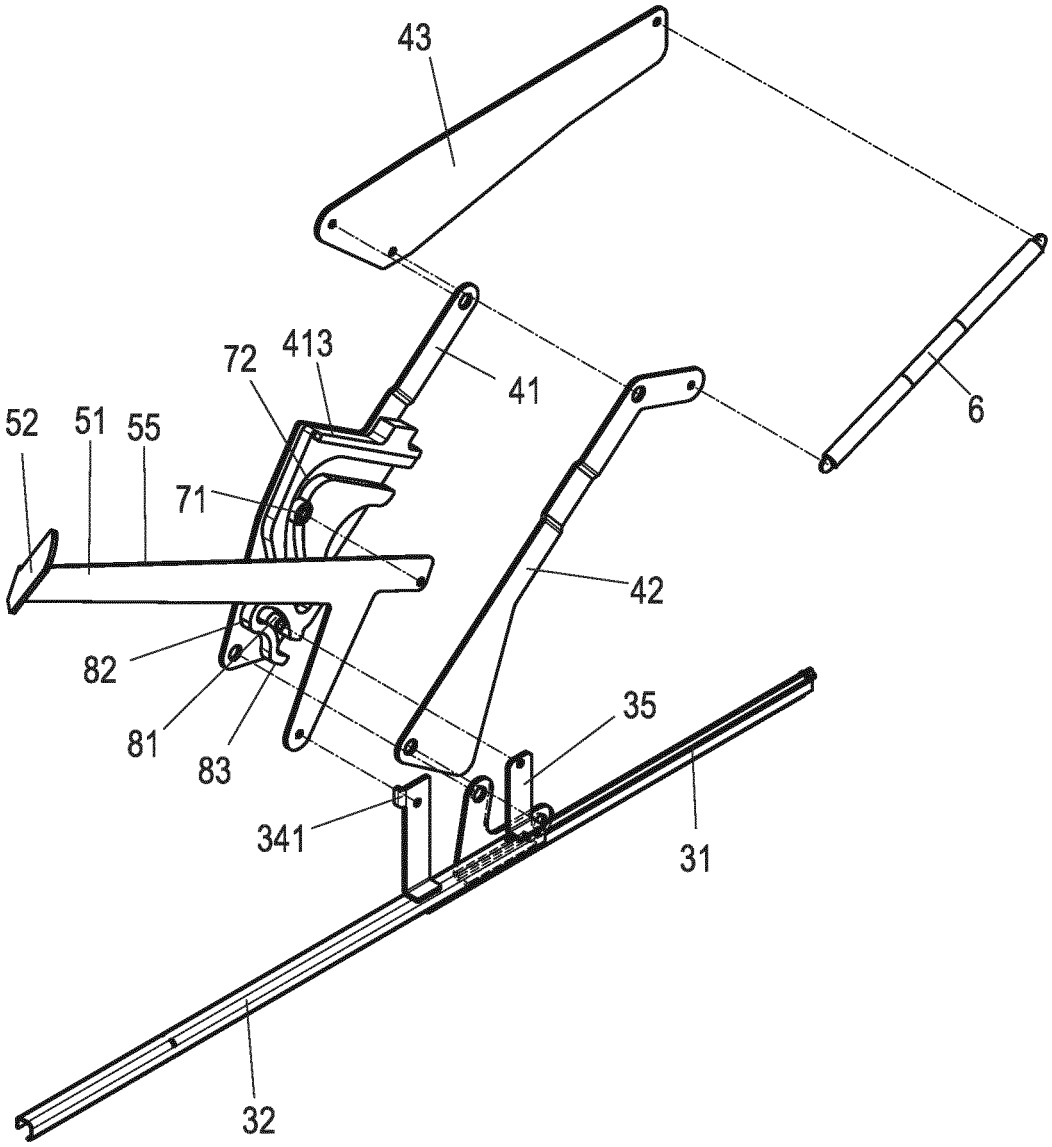
Figure 24:
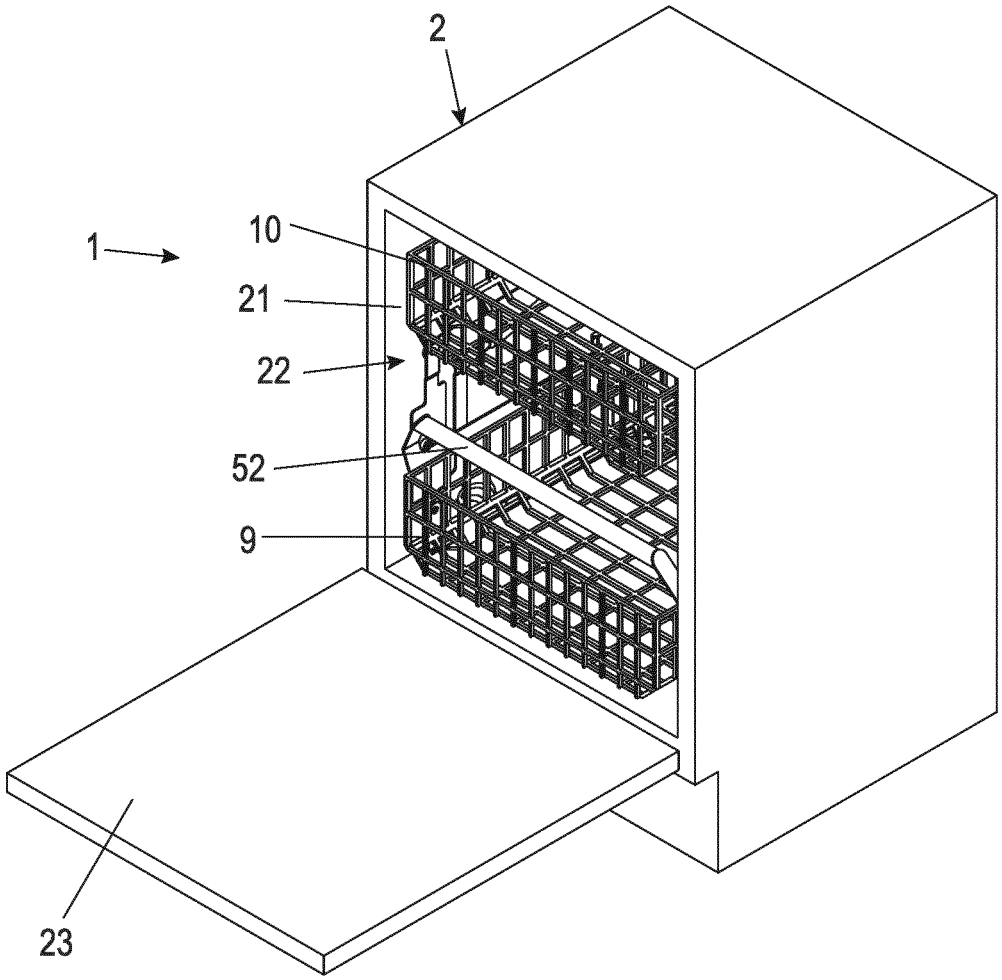
FIGS. 24 to 33 show a third embodiment variant of a sliding-pivoting mechanism according to the invention.

FIG. 23 shows the sliding-pivoting mechanism once again in a perspective exploded illustration.

Details of the third embodiment variant are described hereinafter on the basis of FIGS. 24 to 33.

In the third embodiment variant of the sliding-pivoting mechanism shown in FIGS. 24 to 33, the slotted guide 72 of the first coupling unit 7 is not formed on one of the pivot arms 41, 42, but rather on the rear end of the lever arm 51. In this embodiment variant, the slotted guide 72 represents the coupling element.

The rear end of this lever arm 51 is accordingly formed having a larger area.

The roller 71 formed here as the correspondence element is fastened in this case on the first pivot arm 41.

Figure 27:
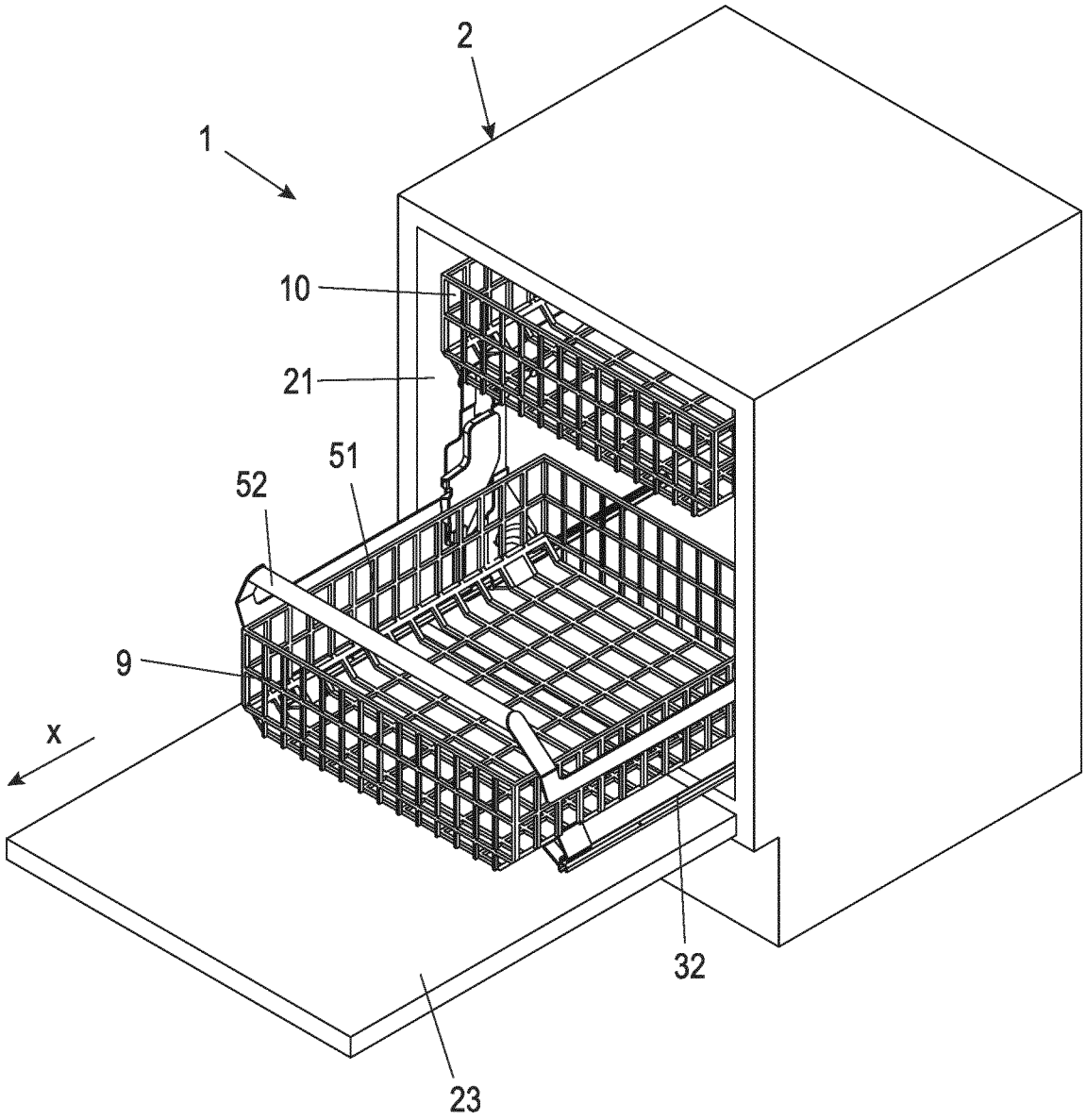
Figure 28:
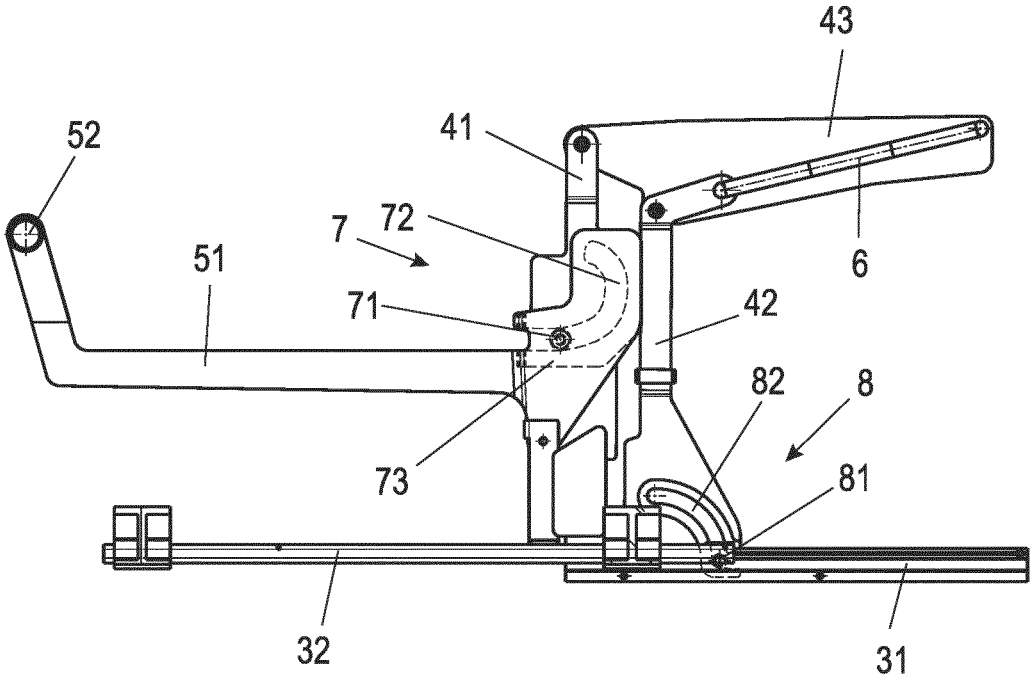

Coupling of the coupling element arranged on the lever arm 51 and formed as the slotted guide 72 with the correspondence element formed as the roller 71 and arranged on the first pivot arm 41 thus first takes place in the position of the shelf 9 extended out of the usable space 22 of the body 2 shown in FIGS. 27 and 28.

The slotted guide 72 of the first coupling unit 7 is also formed here having an inlet region 73 and a curve adjoining thereon.

Figure 29:
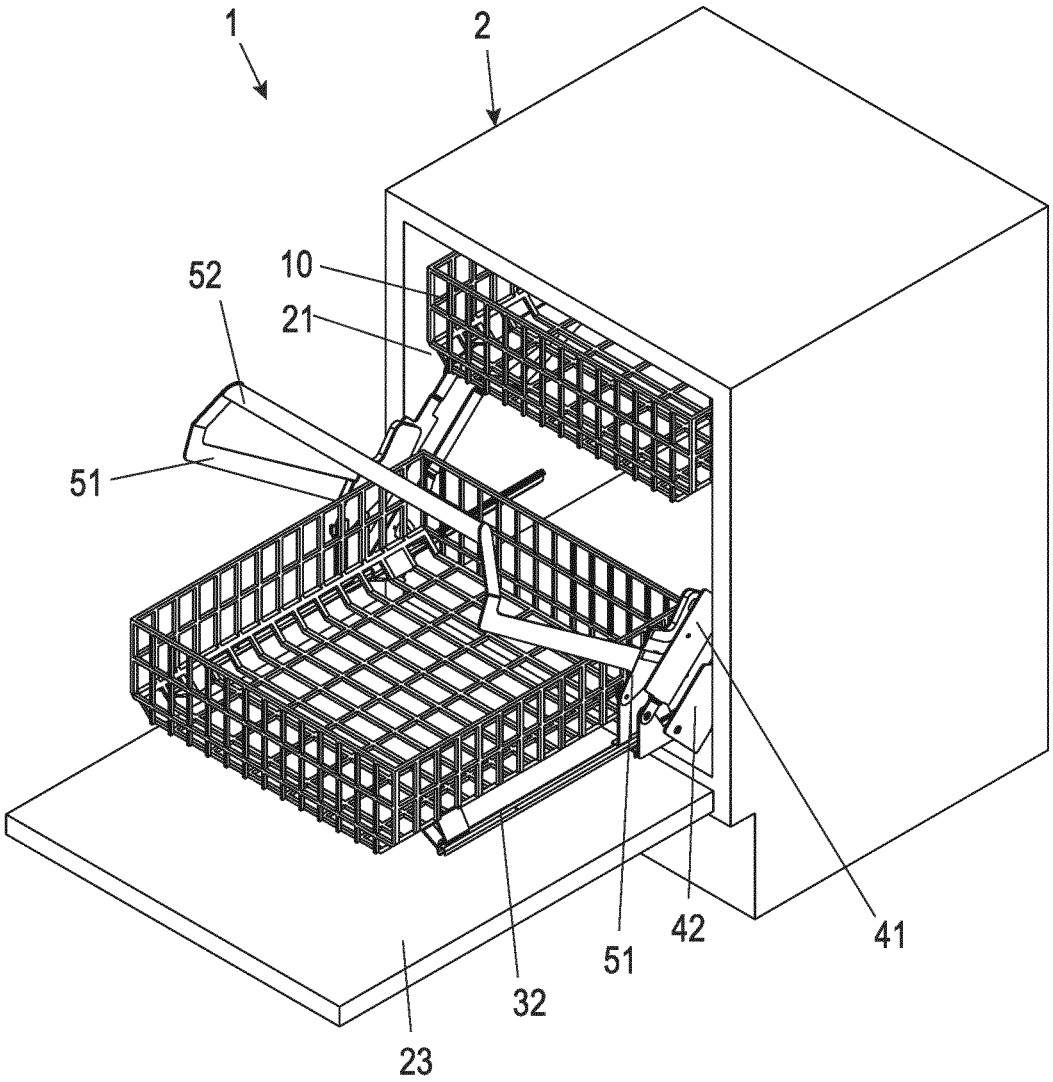
Figure 30:
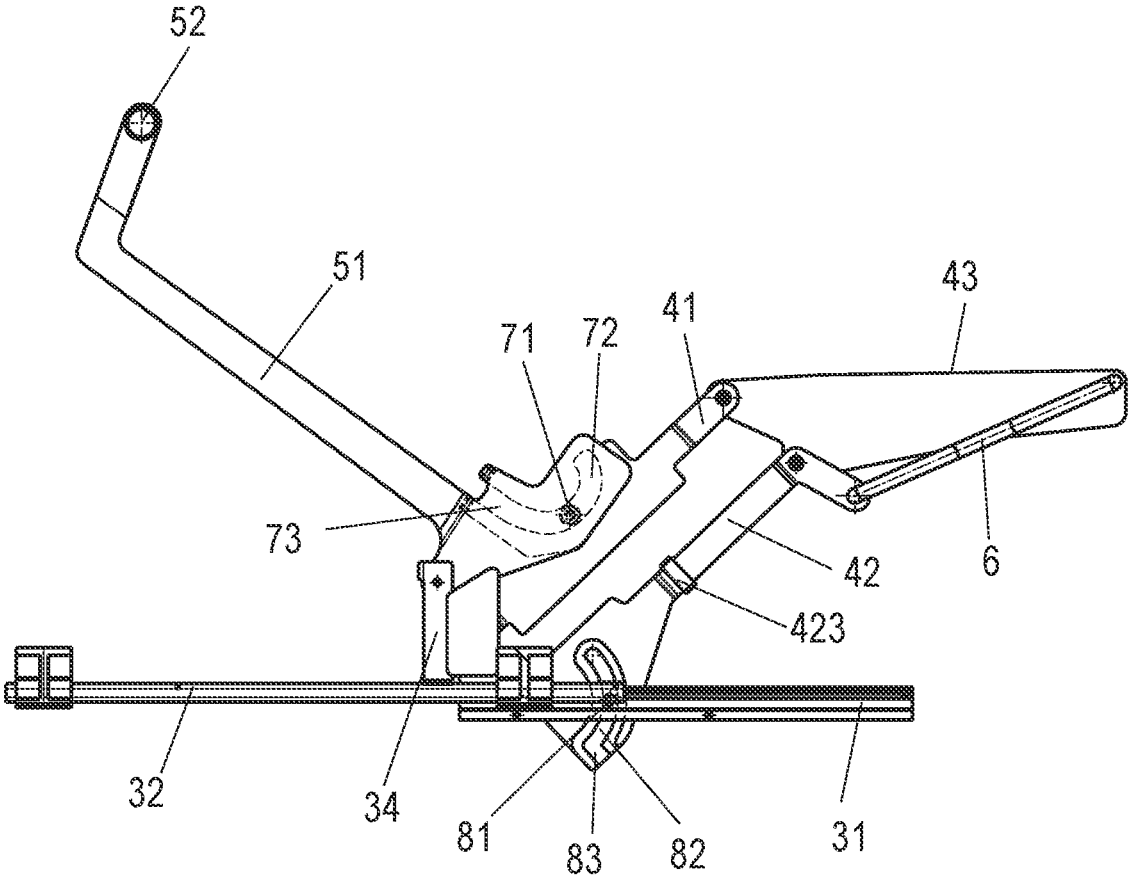
Figure 31:
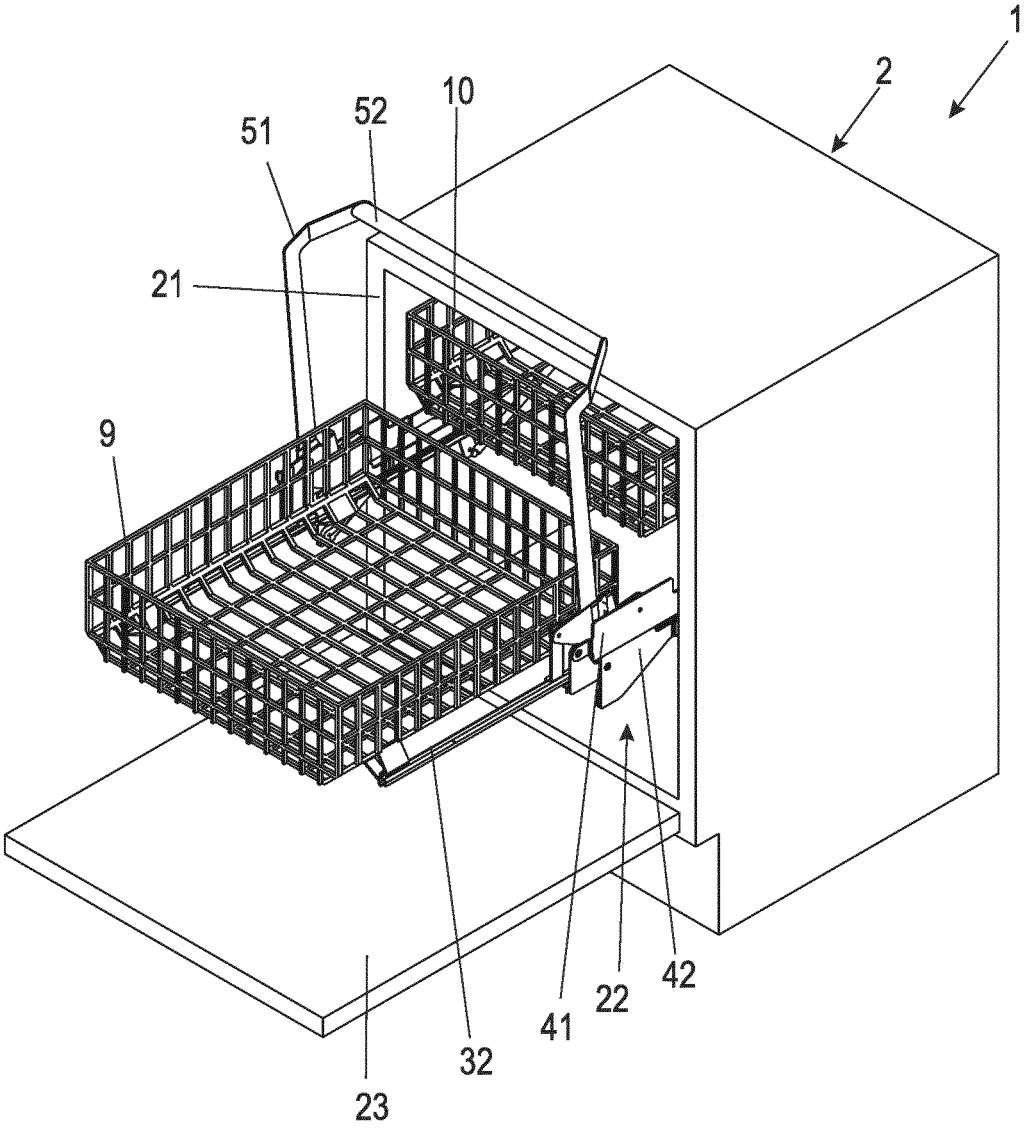
Figure 32:
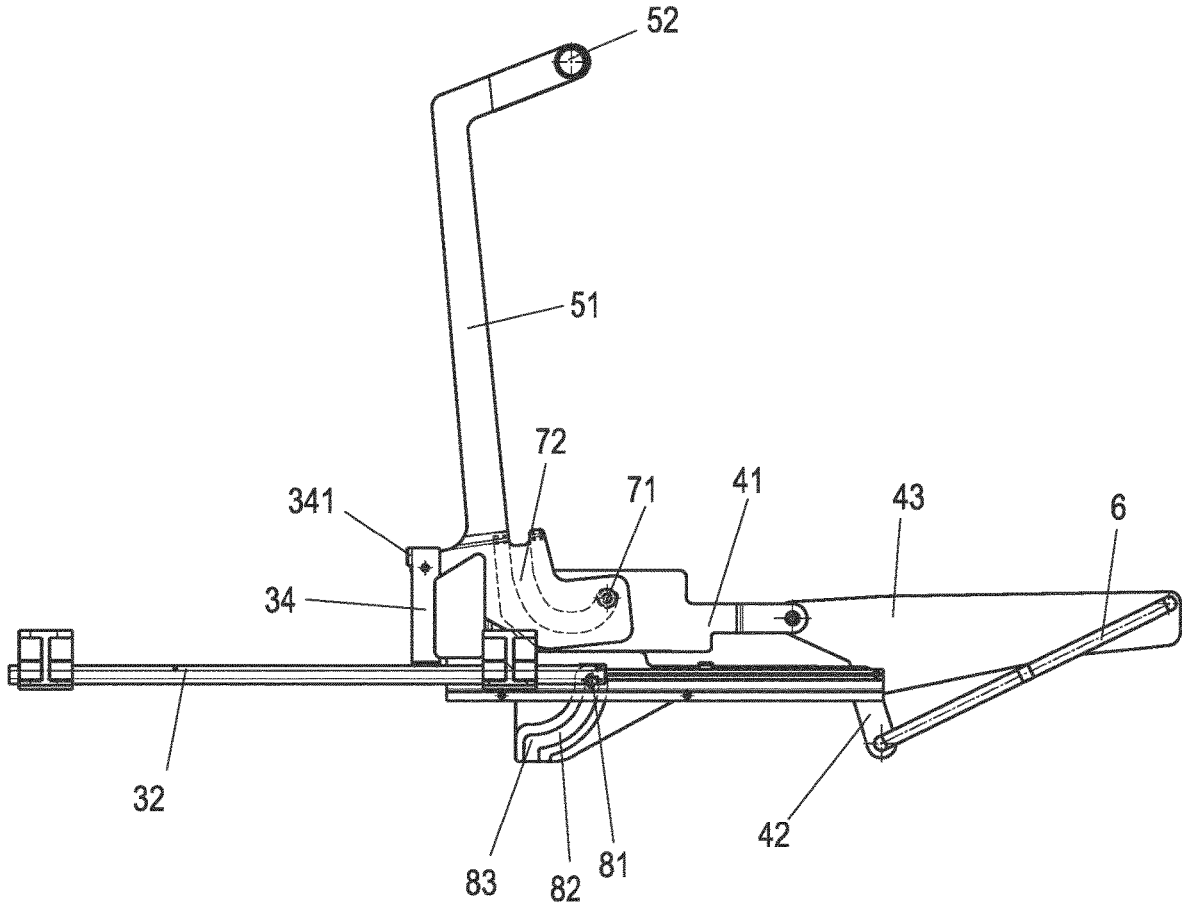

After reaching the extended position of the lower shelf and before raising it, the rollers 71, 81 of the coupling units 7, 8 have also entered the inlet region 73, 83 here and are moved farther in the respective curve regions of the slotted guide 72, 82 during the subsequent raising, as shown in FIGS. 29 and 30, until the lever arm 51 is nearly vertical in the raised end position and the rollers 71, 81 have reached the rear end of the slotted guides 72, 82.

The slotted guide 72 is also shaped in this embodiment variant so that in the raised end position, the shelf 9 remains in a secure position without additional locking and is only lowered again by actuating the lever unit 5.

A perspective exploded illustration of the sliding-pivoting mechanism of this embodiment variant is also shown once again here in FIG. 33.

The roller 71 in this third embodiment variant also has the additional function that during the pulling out of the shelf 9, it prevents the lever arm 51 from pivoting up too early, in that the edge 55 of the lever arm 51 extends under the roller 71 as a guide surface.

FIGS. 34 to 45 show a fourth embodiment variant of a sliding-pivoting mechanism according to the invention.

In contrast to the preceding embodiment variants of the sliding-pivoting mechanism according to the invention, in the embodiment variant shown in FIGS. 34-45, the roller of the first coupling unit is not fastened directly on the end of the lever arm 51 remote from the handle part 52, but rather on an end, which is spaced apart from the end of the lever arm 51, of a joint chain pivotably connected to the lever arm 51.

The joint chain consists in the embodiment variant shown here of two chain links 53, 54, which are each preferably formed as angled webs having suitably formed bends. It is also conceivable to link more than two such chain links to one another to form a joint chain.

Figure 35:
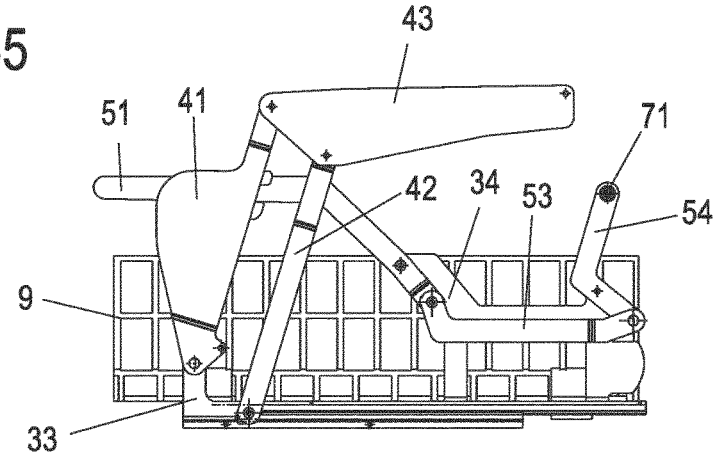
Figure 36:
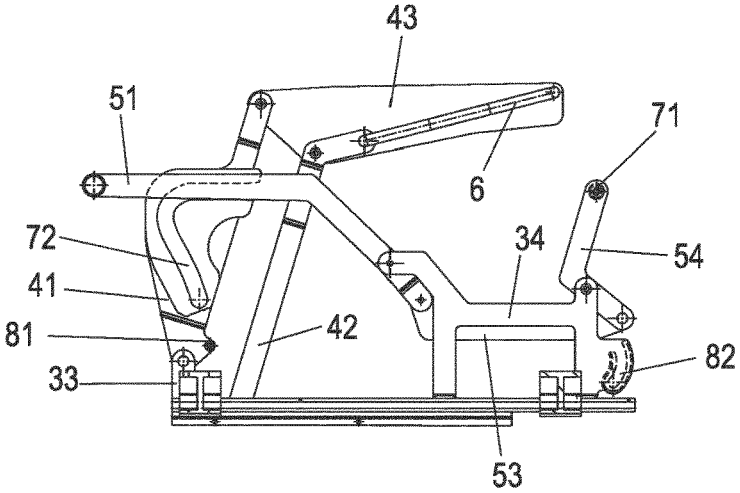
Figure 45:
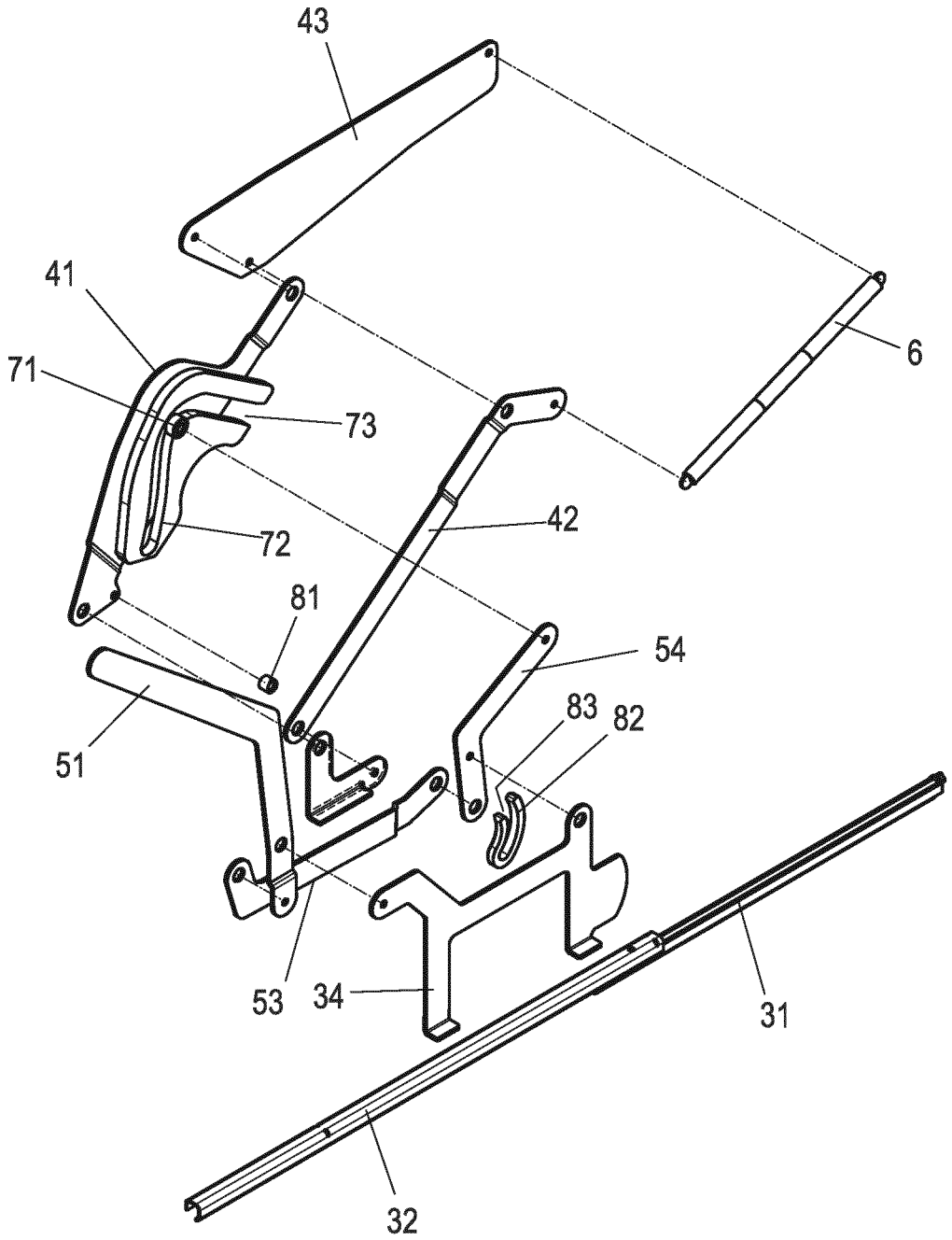

The roller 71 of the first coupling unit 7 is rotatably fastened on the free end of the second chain link 54 spaced apart from the first chain link 53, as shown, for example, in FIG. 35, 36, or 45.

As shown in FIGS. 36, 38, 40, 42, and 45, the slotted guide 72 of the first coupling unit 7 is also formed or fastened in a corresponding broadly embodied section of the first pivot arm 41 on the first pivot arm 41 of the pivot mechanism 4 in this exemplary embodiment.

Figure 34:
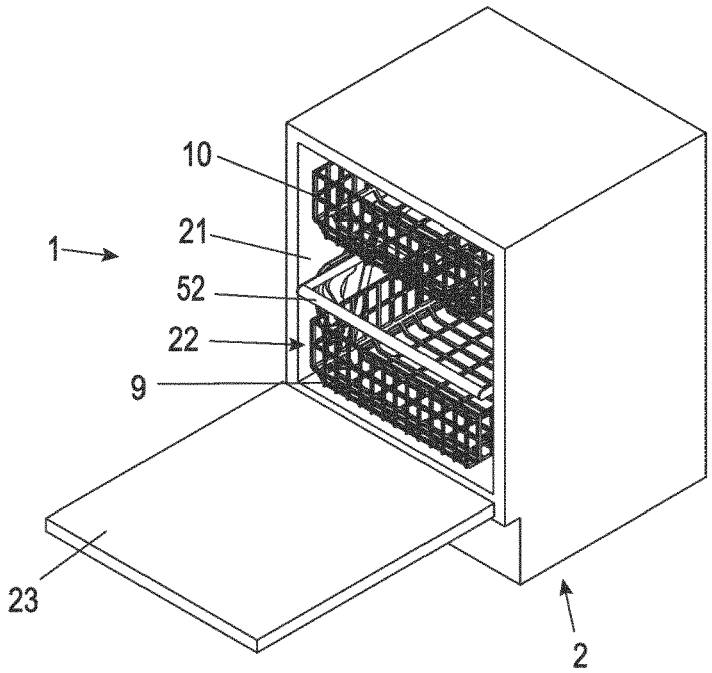
FIGS. 34 to 45 show a fourth embodiment variant of a sliding-pivoting mechanism according to the invention.
Figure 37:
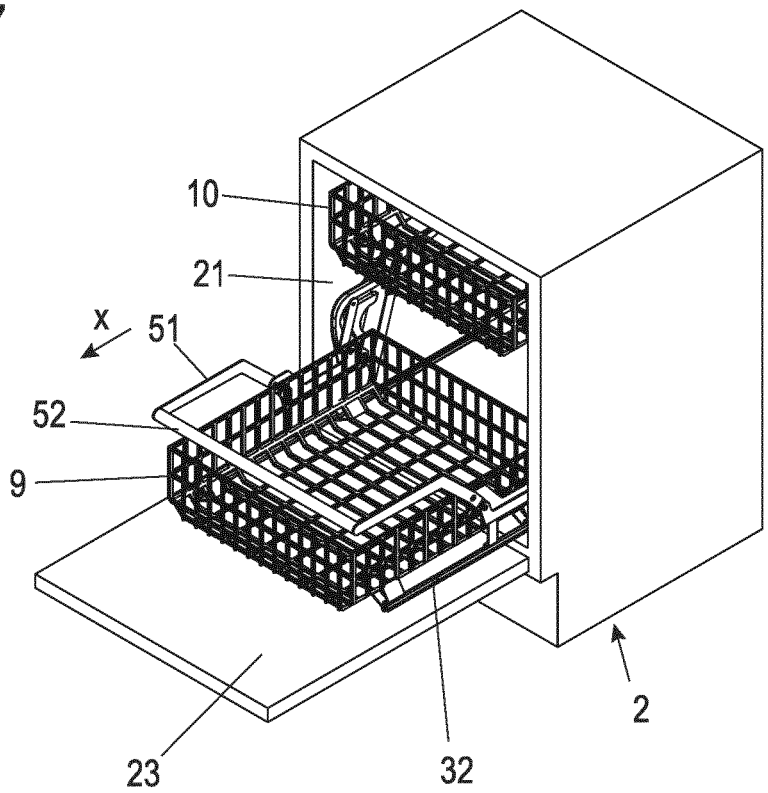
Figure 38:
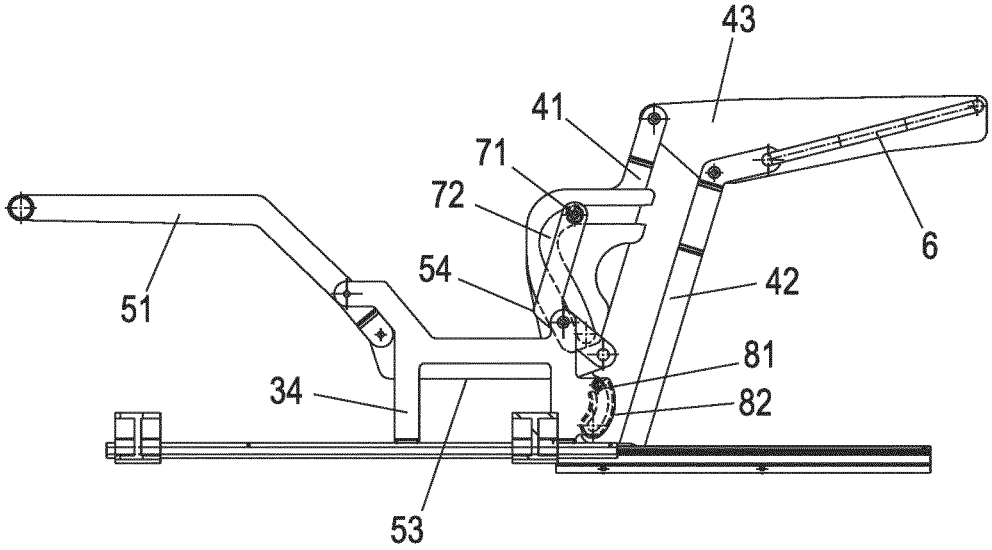
Figure 39:
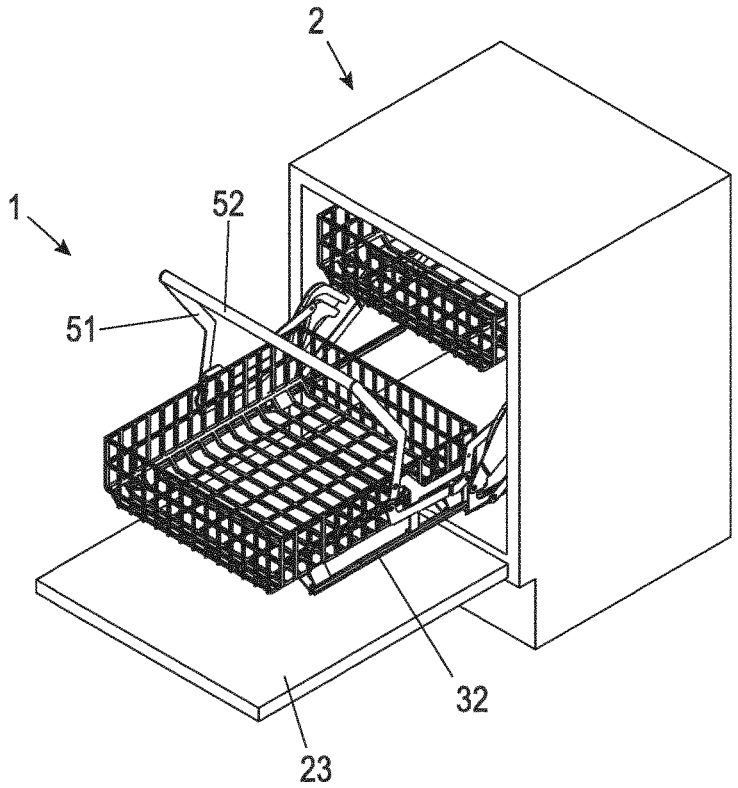
Figure 40:
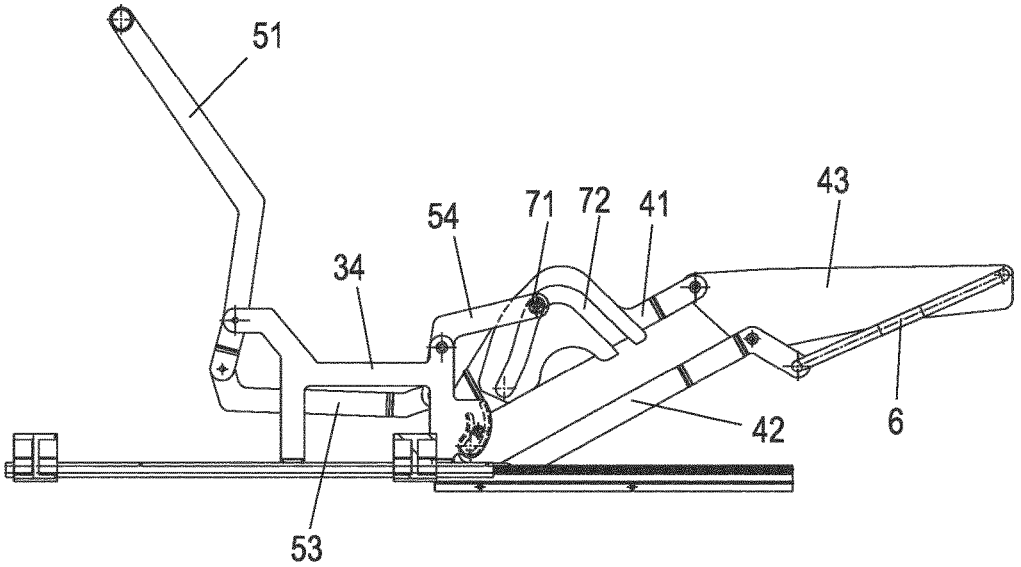
Figure 41:
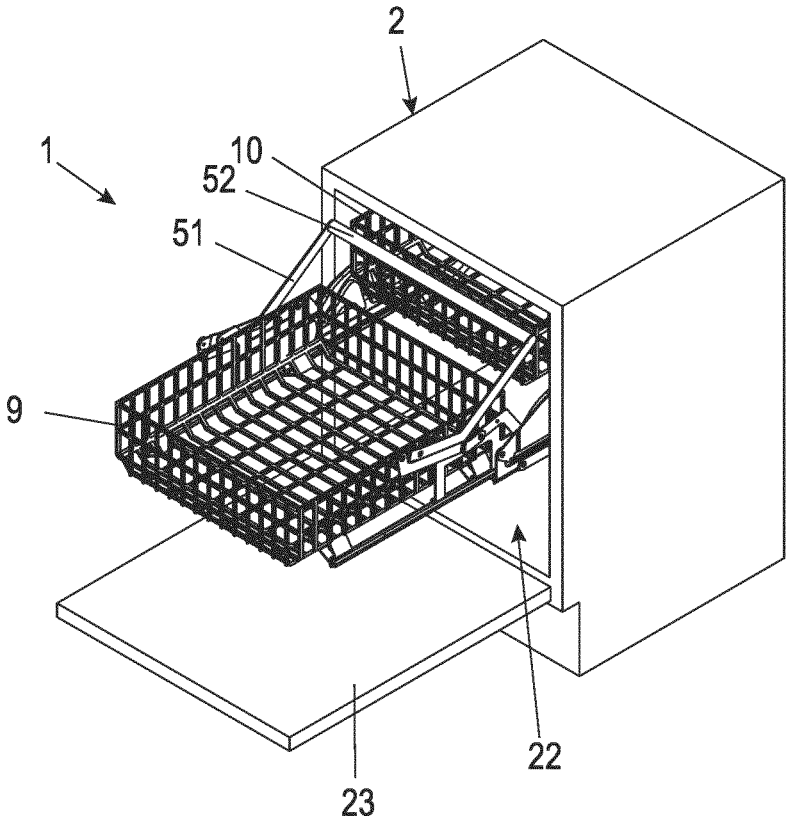
Figure 42:
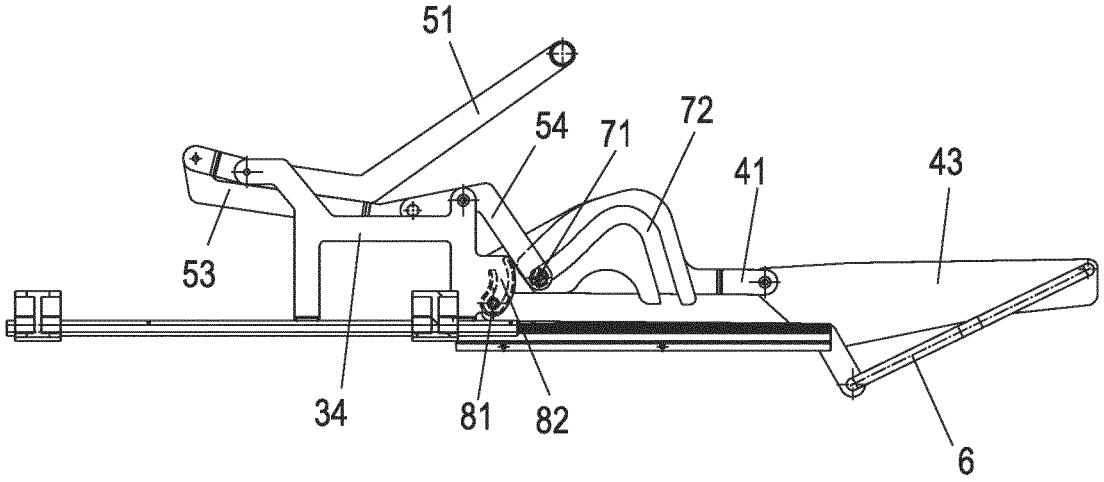
Figure 43:
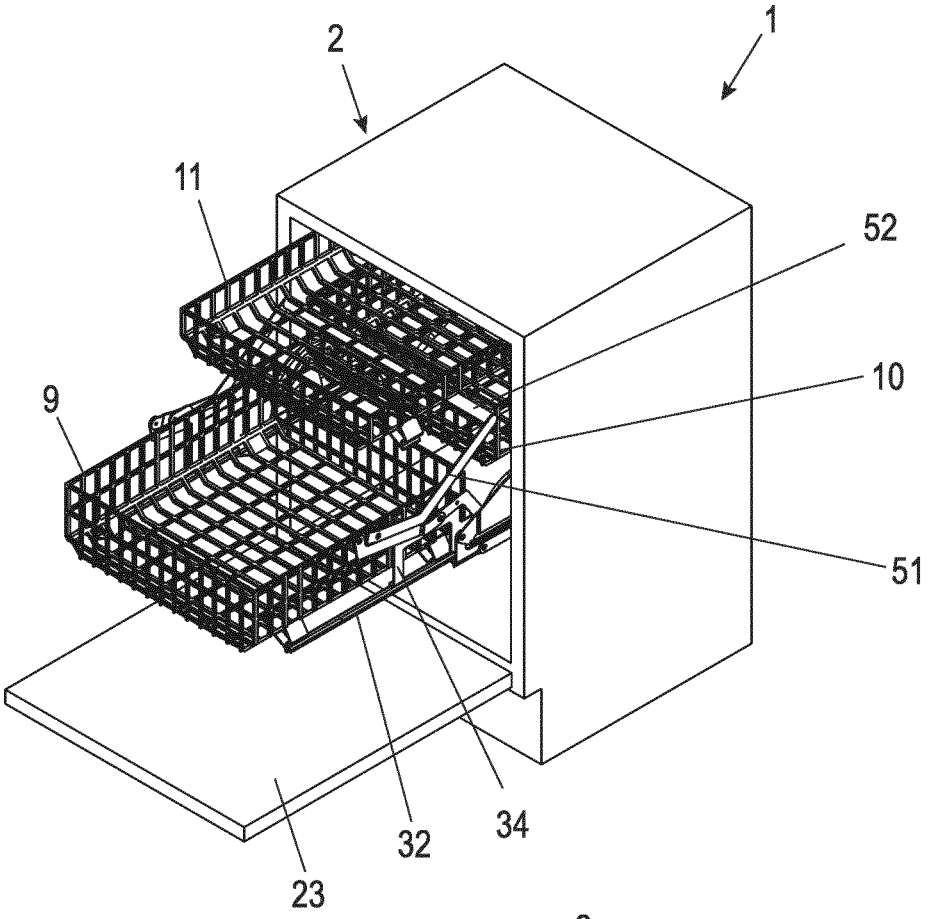
Figure 44:
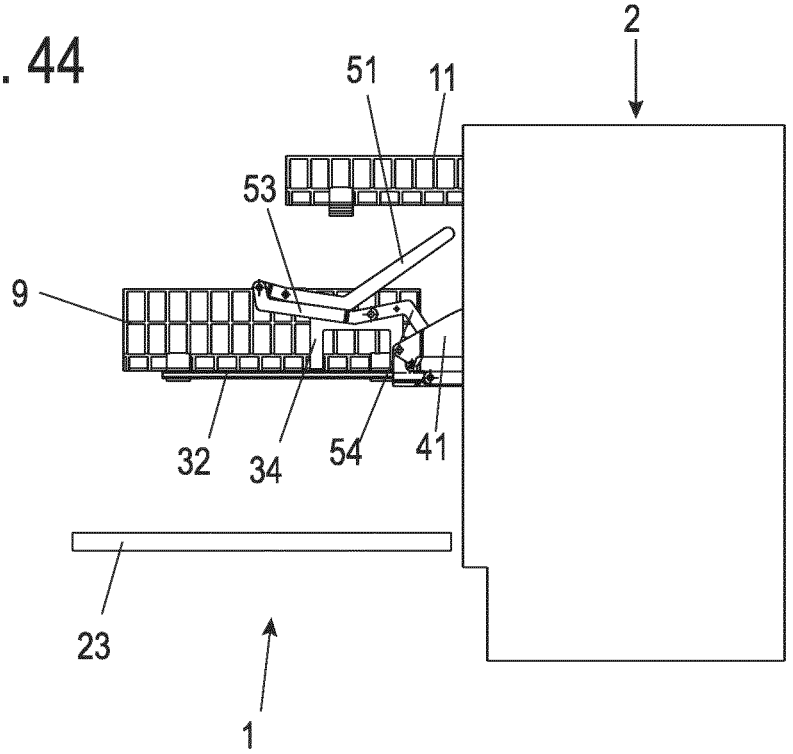

The roller 71 of the first coupling unit 7 is also threaded here into the slotted guide 72 during the movement of the shelf 9 out of the retracted position shown in FIG. 34 into the extended, but not yet raised position shown in FIG. 37.

At the same time, the roller 81 of the second coupling unit 8 is also guided into the inlet region 83 of the slotted guide 82 of the second coupling unit 8 during this movement.

In this embodiment variant, the coupling element of the second coupling unit 8 is designed as a sliding or rolling element 81 rotatably arranged on the first pivot arm 41.

This sliding or rolling element 81 can be guided for the sequence control of the pivot movement of the pivot mechanism 4 in a correspondence element, which is arranged, in particular formed or fastened, on the lever arm mount 34 of the lever arm 51 and is designed as the slotted guide 82.

The joint chain having the chain links 53, 54 coupled to one another as shown here acts in this case according to the toggle lever or drag lever principle.

In the position shown in FIGS. 41 to 44, in which the lower shelf 6 is moved into its raised end position, the arrangement of the roller 71 of the first coupling unit 7 at the end of the joint chain, at the free end of the second chain link 54 here, enables the handle part 52 to be moved close enough to the upper side of the raised lower shelf in the completely raised position that a third shelf 11 optionally arranged in the dishwasher 1 or in another household appliance or piece of furniture, in the uppermost region of the usable space 22, which is designed, for example, as a flatware basket, can still be moved out of the usable space 22 with raised lower shelf 6, i.e., above the handle part 52 in the horizontal direction.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 dishwasher
2 body
21 side wall
22 usable space
23 door
3 pullout guide
31 guide rail
32 slide rail
34 lever arm mount
341 stop
35 roller mount
4 pivot mechanism
41 first pivot lever
411 pivot joint
412 pivot joint
413 stop
42 second pivot lever
421 pivot joint
422 pivot joint
423 sliding surface
424 bead
43 side wall mount
5 lever unit
51 lever arm
52 handle part
53 first chain link
54 second chain link
55 edge
6 force accumulator
7 first coupling unit
71 roller
72 slotted guide
73 inlet region
8 second coupling unit
81 roller
82 slotted guide
83 inlet region
9 shelf
10 shelf
11 shelf
x pullout direction

The invention claimed is:

1. A sliding-pivoting mechanism of a shelf of a piece of furniture or household appliance for pulling out and raising the shelf out of a body of the piece of furniture or household appliance having side walls, sliding-pivoting mechanism comprising:

at least two pivot arms of a pivot mechanism rotatably fixed on at least one of the side walls of the body with a first end parallel to a plane of the side walls and arranged in parallel spaced apart from one another;

a guide rail of a sliding mechanism pivotably fixed in parallel to the plane of the side walls at respective second ends of the pivot arms in such a way that the guide rail is pivotable out of a lower position inside the body into a raised upper position at least partially outside the body;

at least one slide rail, which is linearly displaceable in the guide rail and on which the shelf is fastened;

a lever unit, which assists raising and lowering of the pivot mechanism and is pivotably fixed on the at least one slide rail in parallel to the plane of the side walls; and at least one coupling element of a first coupling unit arranged on the lever unit in such a way that the at least one coupling element can be coupled with a correspondence element, corresponding to the at least one coupling element, of the at least one first coupling unit on a first one of the at least two pivot arms by displacing the at least one slide rail into a predetermined pivot position, wherein the at least one coupling element of the first coupling unit is a slotted guide, in which a correspondence element can be guided for the sequence control of a pivot movement of the lever unit, wherein the correspondence element is arranged on a second one of the at least two pivot arms and is a roller.

2. The sliding-pivoting mechanism of claim 1, further comprising:

at least one coupling element of a second coupling unit arranged on the at least one slide rail or the shelf in such a way that the at least one coupling element can be coupled with a correspondence element, corresponding to the at least one coupling element, of the at least one second coupling unit of at least one of the at least two pivot arms by displacing the at least one slide rail into a predetermined pivot position.

3. The sliding-pivoting mechanism of claim 2, further comprising:

a joint chain pivotably fastened on an end of the at least one lever arm close to a lever arm mount of the at least one lever arm, wherein the correspondence element of the first coupling unit is rotatably fastened on an end of the joint chain remote from the lever arm, wherein the at least one coupling element of the second coupling unit is a sliding or rolling element rotatably arranged on the at least one of the at least two pivot arms, which can be guided in a correspondence element formed on the lever arm mount of the at least one lever arm and is a slotted guide for sequence control of a pivot movement of the pivot mechanism.

4. The sliding-pivoting mechanism of claim 1, wherein the lever unit has at least one lever arm, which is pivotably fixed with a first end on the at least one slide rail in parallel to the plane of the side walls and on which the at least one coupling element or the correspondence element of the first coupling unit is fastened.

5. The sliding-pivoting mechanism of claim 4, further comprising:

a joint chain pivotably fastened on an end of the at least one lever arm close to a lever arm mount of the at least one lever arm, wherein the correspondence element of the first coupling unit is rotatably fastened on an end of the joint chain remote from the lever arm.

6. The sliding-pivoting mechanism of claim 5, wherein the joint chain has at least two chain links coupled to one another in a rotationally articulated manner.

7. The sliding-pivoting mechanism of claim 1, wherein at least a portion of the slotted guide of the first coupling unit has an inlet region.

8. The sliding-pivoting mechanism of claim 1, wherein at least a portion of the slotted guide of the first coupling unit has a shape of a partial circle.

9. The sliding-pivoting mechanism of claim 1, wherein at least a portion of the slotted guide of the first coupling unit has a curve with a varying curve radius.

10. The sliding-pivoting mechanism of claim 1, wherein a portion of the slotted guide of the first coupling unit has a dead center section.

11. The sliding-pivoting mechanism of claim 1, wherein at least a portion of the slotted guide of the first coupling unit has a slope adapted to an optimum actuating force curve.

12. The sliding-pivoting mechanism of claim 1, further comprising:

a safeguard against raising the lever unit before the shelf is completely extended and/or a safeguard against pivoting the lever unit too far during the raising and/or lowering is provided.

13. A piece of furniture, comprising:

a body having side walls;

a shelf fixed in the furniture body by means of a sliding-pivoting mechanism, using which the shelf can be pulled out of the furniture body and raised, wherein the sliding-pivoting mechanism comprises at least two pivot arms of a pivot mechanism rotatably fixed on at least one of the side walls of the body with a first end parallel to a plane of the side walls and arranged in parallel spaced apart from one another;

a guide rail of a sliding mechanism pivotably fixed in parallel to the plane of the side walls at respective second ends of the pivot arms in such a way that the guide rail is pivotable out of a lower position inside the body into a raised upper position at least partially outside the body;

at least one slide rail, which is linearly displaceable in the guide rail and on which the shelf is fastened;

a lever unit, which assists raising and lowering of the pivot mechanism and is pivotably fixed on the at least one slide rail in parallel to the plane of the side walls; and at least one coupling element of a first coupling unit arranged on the lever unit in such a way that the at least one coupling element can be coupled with a correspondence element, corresponding to the at least one coupling element, of the at least one first coupling unit on at least one of the at least two pivot arms by displacing the at least one slide rail into a predetermined pivot position, wherein the at least one coupling element of the first coupling unit is a slotted guide, in which a correspondence element can be guided for the sequence control of a pivot movement of the lever unit, wherein the correspondence element is arranged on the at least one of the at least two pivot arms and is a roller.

14. A dishwasher, cooking appliance, or refrigerator, comprising:

a body having side walls and defining an inner side of a usable space of the dishwasher, cooking appliance, or refrigerator;

a shelf fixed on the inner side of the usable space; and a sliding-pivoting mechanism configured to pull out and raise the shelf from the inner side of the useable space, wherein the sliding-pivoting mechanism comprises at least two pivot arms of a pivot mechanism rotatably fixed on at least one of the side walls of the body with a first end parallel to a plane of the side walls and arranged in parallel spaced apart from one another;

a guide rail of a sliding mechanism pivotably fixed in parallel to the plane of the side walls at respective second ends of the pivot arms in such a way that the guide rail is pivotable out of a lower position inside the body into a raised upper position at least partially outside the body;

at least one slide rail, which is linearly displaceable in the guide rail and on which the shelf is fastened;

a lever unit, which assists raising and lowering of the pivot mechanism and is pivotably fixed on the at least one slide rail in parallel to the plane of the side walls; and at least one coupling element of a first coupling unit arranged on the lever unit in such a way that the at least one coupling element can be coupled with a correspondence element, corresponding to the at least one coupling element, of the at least one first coupling unit on at least one of the at least two pivot arms by displacing the at least one slide rail into a predetermined pivot position, wherein the at least one coupling element of the first coupling unit is a slotted guide, in which a correspondence element can be guided for the sequence control of a pivot movement of the lever unit, wherein the correspondence element is arranged on the at least one of the at least two pivot arms and is a roller.

* * * * *